US011255027B2

(12) United States Patent
Matsuura et al.

(10) Patent No.: US 11,255,027 B2
(45) Date of Patent: Feb. 22, 2022

(54) GLOSSY FIBER

(71) Applicant: Toray Industries, Inc., Chuo-ku (JP)

(72) Inventors: Tomohiko Matsuura, Mishima (JP); Masato Masuda, Mishima (JP); Hiroshi Tsuchikura, Otsu (JP); Shinya Nakamichi, Otsu (JP)

(73) Assignee: Toray Industries, Inc., Tokyo (JP)

( * ) Notice: Subject to any disclaimer, the term of this patent is extended or adjusted under 35 U.S.C. 154(b) by 311 days.

(21) Appl. No.: 16/349,760

(22) PCT Filed: Nov. 14, 2017

(86) PCT No.: PCT/JP2017/040839
§ 371 (c)(1),
(2) Date: May 14, 2019

(87) PCT Pub. No.: WO2018/092746
PCT Pub. Date: May 24, 2018

(65) Prior Publication Data

US 2019/0330769 A1 Oct. 31, 2019

(30) Foreign Application Priority Data

Nov. 15, 2016 (JP) ..... JP2016-222338
Jun. 30, 2017 (JP) ..... JP2017-128833

(51) Int. Cl.
*D01F 8/04* (2006.01)
*D01F 1/10* (2006.01)

(52) U.S. Cl.
CPC ..... *D01F 8/04* (2013.01); *D01F 1/106* (2013.01); *D10B 2401/20* (2013.01)

(58) Field of Classification Search
None
See application file for complete search history.

(56) References Cited

U.S. PATENT DOCUMENTS

| | | | |
|---|---|---|---|
| 3,803,453 | A | 4/1974 | Hull |
| 5,472,798 | A | 12/1995 | Kumazawa et al. |
| 5,849,383 | A | 12/1998 | Kumazawa et al. |
| 6,051,513 | A | 4/2000 | Kumazawa et al. |
| 6,243,521 | B1 | 6/2001 | Owaki et al. |
| 6,306,529 | B1 | 10/2001 | Shimizu et al. |
| 6,430,348 | B1 | 8/2002 | Asano et al. |

(Continued)

FOREIGN PATENT DOCUMENTS

| | | | |
|---|---|---|---|
| CN | 1225694 | A | 8/1999 |
| CN | 1226940 | A | 8/1999 |
| CN | 102453975 | | 5/2012 |

(Continued)

OTHER PUBLICATIONS

The First Office Action dated Jan. 27, 2021, of counterpart Chinese Application No. 201780070405.4, along with an English translation.

(Continued)

*Primary Examiner* — Shawn Mckinnon
(74) *Attorney, Agent, or Firm* — DLA Piper LLP (US)

(57) ABSTRACT

Glossy fibers can be processed into woven or knitted fabric suitable for clothing applications while exhibiting a sense of deep, lustrous glossiness. The glossy fibers are characterized by having an average reflectance for the visible light region of 20% or greater, an average transmittance of 40% of less, and a contrastive glossiness of 3.0 or less.

7 Claims, 5 Drawing Sheets

(56) References Cited

U.S. PATENT DOCUMENTS

2007/0009221 A1 1/2007 Kamiyama et al.

FOREIGN PATENT DOCUMENTS

| | | | |
|---|---|---|---|
| JP | 36-20770 | B | 10/1936 |
| JP | S36-20770 | B | 10/1936 |
| JP | 03-027108 | A | 2/1991 |
| JP | 03-130406 | A | 6/1991 |
| JP | 7-34324 | A | 2/1995 |
| JP | 7-331532 | A | 12/1995 |
| JP | 9-157957 | A | 6/1997 |
| JP | 11-124747 | A | 5/1999 |
| JP | 11-181630 | A | 7/1999 |
| JP | 2002-307602 | A | 10/2002 |
| JP | 2006-063462 | A | 3/2006 |
| JP | 2006-161218 | A | 6/2006 |
| JP | 2006-233357 | A | 9/2006 |
| JP | 2008-231643 | A | 10/2008 |
| JP | 2011-208313 | A | 10/2011 |
| KR | 10-2012-0002375 | A | 1/2012 |
| TW | 201018758 | A | 5/2010 |
| WO | 98/46815 | A1 | 10/1998 |
| WO | 2005/021849 | A1 | 3/2005 |

OTHER PUBLICATIONS

Office Action dated Aug. 19, 2020, of counterpart Indonesian Application No. P00201904081, along with an English translation.

Office Action dated Apr. 29, 2020, of counterpart Taiwanese Application No. 106139510, along with an English translation.

The Extended European Search Report dated Jun. 2, 2020, of counterpart European Application No. 17872790.5.

Office Action dated Oct. 28, 2020, of counterpart Korean Application No. 10-2019-7013640, along with an English translation.

Examination Report dated Nov. 3, 2021, of counterpart Indian Application No. 201947019141, with English translation.

GLOSSY FIBER

TECHNICAL FIELD

This disclosure relates to glossy fiber having such excellent properties that the glossy fiber not only has a deep lustrous gloss imparted by regulating the average reflectance, average transmittance, and contrast gloss in a visible-light region, but also can be processed into a woven or knit fabric suitable for garment applications.

BACKGROUND

Synthetic fibers made of polyesters, polyamides or the like have excellent mechanical properties and dimensional stability and are hence in extensive use in applications ranging from garment applications to non-garment applications. Nowadays, however, people live diversified lives and desire better lives, and there is hence a desire for fibers having a high degree of sense or functions not possessed by any conventional synthetic fibers, in many applications including garments.

With respect to the development of techniques regarding synthetic fibers, it is not too much to say that the progress of elementary techniques therefor has been made by imitating natural materials as a motivation. For example, to obtain the gloss peculiar to a natural material, investigations have been extensively made on techniques ranging from polymer techniques to fiber formation techniques including design of the cross-sectional shapes of fibers.

This is because the gloss of a natural material is more complicated and fascinating and has a high-grade sense compared to the monotonous glosses possessed by single fibers. The following have been disclosed as fiber techniques aiming at obtaining a lustrous gloss produced by the complicated structure of a natural material.

For example, JP-B-36-20770 discloses a synthetic fiber having a noncircular cross-section and improved light-reflecting surface properties due to the cross-section and has a thus imparted gloss such as that of silk, which is natural fibers of high rank.

JP-A-2006-161218 discloses a fiber having a noncircular cross-section and contains fine voids inside so that the noncircular cross-section and light reflection due to the fine voids produce a synergistic effect, which enables the fiber to have a high-grade gloss similar to that of natural silk.

JP-A-2002-307602, for example, discloses a golden or silvery filament obtained by vapor-depositing a metal on a fiber itself and a metal-coated slit filament obtained by vapor-depositing a metal on paper or a film and slitting the metal-coated paper or film, for the purpose of imparting a deep lustrous gloss to synthetic fibers or to woven or knit fabrics configured of synthetic fibers.

In JP-A-7-34324 and WO 1998/46815, the phenomenon in which a fine structure represented by ones in buprestids or morpho butterflies produces a color is utilized to propose a structurally colored fiber having an accurately controlled cross-sectional shape to thereby have any desired color in the visible-light region.

In JP '324 and WO '815, two polymers differing in refractive index are alternately superposed to form an alternating multilayer structure while accurately controlling the number of superposed layers and the thickness of each layer, thereby making it possible to impart structural coloring due to the interference and reflectance of light. Unlike conventional coloring by dyes, the structural coloring thus obtained is expected to produce both a high gloss and a deep color tone.

Although there are techniques concerning fibers having a gloss similar to natural glosses such as those disclosed in JP '770 and JP '218, no fiber having a deep lustrous gloss such as those of natural metals having a high-grade sense, and that sufficiently satisfies properties required for use in garment applications has been obtained hitherto.

The method in which a metal is vapor-deposited on a fiber disclosed in JP '602 has a drawback in that the thin metal film may crack due to friction caused by fiber processing such as twisting or knitting/weaving, or by laundering, resulting in loss of the gloss. In addition, to vapor-deposit a metal on individual fibers is exceedingly poor in production efficiency. Even in a relatively efficient production method in which a metal is vapor-deposited at a time on a film or the like and the coated film or the like is slit, the slit filaments are undesirably thick and flat compared to the fibers in ordinary use in garment applications and, hence, the woven or knit fabric obtained therefrom often has a problem in that the fabric is poor in softness.

Furthermore, the fibers proposed in JP '324 and WO '815 have a cross-section including superposed platy structures and, hence, naturally has a flat contour because of the superposed platy structures included therein. Moreover, since the superposed platy structures are superposed layers of incompatible polymers, interlaminar separation is prone to occur and it is necessary to dispose a thick protective layer around the multilayer structure to prevent the interlaminar separation. Because of this, there are considerable limitations on fiber processing, the possible structure of the fabric and, above all, there is a problem in that the single filaments have a larger diameter and, hence, the fabric produced from the composite fiber has an exceedingly stiff feeling and is poor in softness.

The fibers of JP '324 and WO '815 further have a drawback in that the arrangement of single filaments is disordered by fiber processing and, hence, the structurally colored fiber is possible only with a limited structure capable of yielding the intended bundle of fibers having a uniform cross-section. Because of this, it is difficult to sufficiently obtain the expected structural coloring when the composite fiber is used to merely produce a simple woven or knit fabric. There also is, for example, surface reflection due to the thick protective layer. Consequently, there are often examples where a visible coloration is not obtained, and it has been difficult to apply the composite fiber to garment textiles appealing the aesthetic properties.

It could therefore be helpful to provide a glossy fiber having a deep lustrous gloss and can be processed into a woven or knit fabric suitable for garment applications.

SUMMARY

We thus provide:

(1) A glossy fiber having, in a visible-light wavelength region, an average reflectance of 20% or higher, an average transmittance of 40% or less, and a contrast gloss of 3.0 or less;

(2) The glossy fiber according to (1), having a cross-section along a direction perpendicular to a fiber axis, the cross-section having an inscribed circle diameter $R_B$ and a circumscribed circle diameter $R_C$ for the fiber which have a relationship represented by $1.0 \leq R_C/R_B \leq 3.0$;

(3) The glossy fiber according to (1) or (2), containing light-absorbing particles in an amount of 0.01-5.0 wt % in at least one polymer constituting the fiber, the light-absorbing particles having an average transmittance of 40% or less in the visible-light wavelength region;

(4) The glossy fiber according to any one of (1) to (3), containing air voids in a number density of 5.0 voids/$\mu m^2$ or higher in at least one polymer constituting the fiber;

(5) The glossy fiber according to (1), having a cross-section which includes a multilayer region including superposed layers of two polymers, and a non-multilayer region including a polymer that differs in kind from the polymers of the multilayer region;

(6) The glossy fiber according to (5), in which, in the multilayer region, the different polymers are concentrically superposed in layers, the layers each having a thickness of 0.01 μm to 1.0 μm, the number of the superposed layers being 5 or larger;

(7) The glossy fiber according to (5) or (6), in which, in the cross-section, an areal proportion of the multilayer region to the non-multilayer region is 50/50 to 95/5;

(8) The glossy fiber according to any one of (5) to (7), in which the multilayer region is divided by the non-multilayer region into two or more portions; and (9) A fibrous product, at least a part of which is constituted of the glossy fiber according to any one of (1) to (8).

The glossy fiber has such excellent properties that the glossy fiber not only has a deep lustrous gloss, but also can be processed into a woven or knit fabric suitable for garment applications.

DESCRIPTION OF REFERENCE NUMERALS AND SIGNS

Figure 1A:
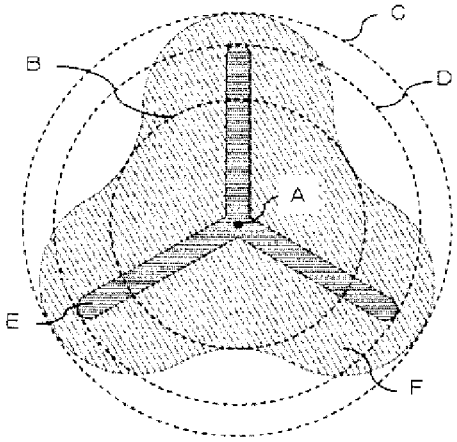
FIGS. 1(*a*) and 1(*b*) are diagrammatic views of the cross-sectional structure of our fiber.

A: Intersection (fiber center) of any two straight lines each dividing fiber cross-section into two portions equal in area B: Complete circle (inscribed circle) inscribed in fiber cross-section at two or more points C: Complete circle (circumscribed circle) circumscribed about fiber cross-section at two or more points D: Complete circle (circumscribed circle) circumscribed about light absorption region of fiber cross-section at two or more points E: Light absorption region F: Light reflection region G: Outer layer of alternating multilayer structure constituting light reflection region H: Inner layer of alternating multilayer structure constituting light reflection region I: Any point in light reflection region lying on outermost layer of fiber cross-section J: Straight line drawn to fiber center from any point in light reflection region lying on outermost layer of fiber cross-section K: Multilayer region 1

L: Multilayer region 2

M: Non-multilayer region

N: Any straight line drawn to fiber center from any point lying on fiber surface O: Any point on fiber surface

1: Metering plate

2: Distribution plate

3: Ejection plate

DETAILED DESCRIPTION

Our fibers are described below together with desirable examples thereof.

The deep and lustrous gloss of a natural substance, e.g., a metal such as gold or silver, is said to be produced by a complicated mechanism in which the energy of light which has struck on the metal surface is first absorbed by free electrons within the metal and thereafter released as light. Namely, it can be understood that a balance between the light absorption and reflection in the complicated phenomenon produces the deep lustrous gloss peculiar to the natural substance.

It has been regarded as difficult for fiber-shaped materials to have such a gloss. However, we discovered that the gloss is specifically produced by regulating the average reflectance, average transmittance, and contrast gloss in a visible-light wavelength region to values within specific ranges.

Specifically, it is required to control the following optical parameters. First, from the standpoint of the intensity of gloss, a first requirement is that the average reflectance in a visible-light wavelength region is 20% or higher.

The term "visible-light wavelength region" means a wavelength range of 300 nm to 800 nm. When a fiber has an average reflectance in that wavelength range of 20% or higher, the gloss can be intensely recognized with the human eye. The average reflectance can be evaluated using a spectrophotometer including an illuminant capable of measuring in the visible-light wavelength region such as, for example, a tungsten lamp. That average reflectance is an average of reflectances measured at wavelength intervals of 10 nm in the visible-light wavelength region. Specifically, each sample is examined for relative diffuse reflectance (including specular reflection) at a light incidence angle of 8°, with the reflection on a standard white board ($BaSO_4$) being taken as 100. Reflectance values for the visible-light wavelength region (300 nm to 800 nm) are extracted from the reflectance values measured at wavelength intervals of 10 nm, and an average thereof is determined. Ten portions in total of each sample were subjected to the examination, in which the measurement was made three times for each portion, and a simple number average of the results was determined. The number average was rounded off to the nearest whole number to obtain the average reflectance.

The glossy fiber has a fascinating glossy sense even when the glossy fiber is processed into a structure with which the glossy sense of the material is generally less apt to appeal such as the woven or knit fabric formed by bending fibers. From this standpoint, the higher the average reflectance, the more the glossy fiber is preferred. From the standpoint of lowering limitations of the structure to improve the visibility of glossy sense, it is preferable that the average reflectance is 40% or higher.

Enhancement of such an idea enables the feature of the material to be sensed with the human eye regardless of the lightness or darkness of the atmosphere such as illumination. It is possible to obtain a material having a unique appearance that changes variously depending on changing atmospheres. Such a feature is observed especially when the average reflectance is 60% or higher, and that range hence is more preferred.

It is, however, noted that when a material including the glossy fiber that has been made to have an excessively high average reflectance is processed by dyeing or the like and used as a colored material, the resultant material is presumed to show too high reflection of white light, resulting in a decrease in apparent coloration. Because of this, for use in applications where coloration is necessary such as garment applications, a practical upper limit of the average reflectance is 99%.

Next, from the standpoint of the deepness of gloss, the glossy fiber needs to have an average transmittance of 40% or less.

The average transmittance can be evaluated using a spectrophotometer such as that for determining the average reflectance, which includes an illuminant capable of measuring in the visible-light wavelength region such as, for example, a tungsten lamp. The term "average transmittance" herein means an average of transmittances measured at wavelength intervals of 10 nm in the visible-light wavelength region. Specifically, each sample is examined, at a light incidence angle of 0°, for the proportion of the reflection on a standard white board ($BaSO_4$), which is taken as 100, in the light transmitted through the sample. Values for the visible-light wavelength region (300 nm to 800 nm) are extracted from the values measured at wavelength intervals of 10 nm, and an average thereof is determined. Ten portions in total of each sample were subjected to the examination, in which the measurement was made three times for each portion, and a simple number average of the results was determined. The number average was rounded off to the nearest whole number to obtain the average transmittance.

Background techniques aimed to imitate the glossy sense of a natural material by contriving the cross-section of a fiber to enhance the gloss of the fiber. However, since the background techniques were intended to enhance gloss, there have been examples where the excessive gloss is recognized as whitishness or glaringness and it is difficult to impart a glossy sense with deepness such as those of natural substances. Since our glossy fiber has a reduced average transmittance, this glossy fiber is considerably inhibited from having whitishness or glaringness, which have hitherto been a problem, and produces a peculiar phenomenon in which an intense glossy sense comes to have deepness to thereby become a lustrous glossy sense.

It is preferred to regulate the average transmittance in accordance with, for example, a desired textile style. However, when the average transmittance is 20% or less, not only an intense glossy sense (average reflectance), but also a gloss with fascinating shades and shadows due to ruggedness can be expressed in wide fabrics. That range hence is a preferred range. From the standpoint of the deepness of gloss, there is a tendency that the lower the average transmittance, the higher the deepness. However, in view of the fact that a fabric or the like actually produced from the fiber by higher-order processing has openings and has interstices among the individual fibers, a practical lower limit of the average transmittance is 0.1%.

In addition, from the standpoints of attaining a deep glossy sense produced by a balance between the average reflectance and average transmittance of the glossy fiber and rendering the deep glossy sense a lustrous fascinating one unattainable with any conventional synthetic fibers, the glossy fiber needs to have a contrast gloss of 3.0 or less.

The contrast gloss can be evaluated using an automatic gonio-photometer including both an illuminant capable of measuring in the visible-light wavelength range such as, for example, a tungsten lamp, and a photodetector for the illuminant. The term "contrast gloss" means a ratio between specular reflection and diffuse reflection.

Specifically, light is caused to strike on each sample at an incidence angle of 60° to determine light intensity over the light-receiving angle range of 0°-90° at intervals of 0.1° through a two-dimensional reflected-light distribution measurement. The term "contrast gloss" means a value obtained by dividing a maximum light intensity (specular reflection), observed at around a light-receiving angle of 60°, by a minimum light intensity (diffuse reflection), observed at around a light-receiving angle of 0°. Ten portions in total of each sample were subjected to the examination, in which the measurement was made three times for each portion, and a simple number average of the results was determined. The number average was rounded off to the nearest tenth to obtain the contrast gloss of the sample being evaluated.

The smaller the value of the contrast gloss, which is thus evaluated, the smaller the difference between the specular reflection and the diffuse reflection. Namely, small values of the contrast gloss mean that the gloss is mild and has a small dependence on viewing angle. The glossy fiber enables fibrous products of any structure to be materials having a deep lustrous gloss. From this standpoint, it is preferred to design a low contrast gloss. Namely, the fiber needs to have a contrast gloss of 3.0 or less as a property whereby an even gloss is observed from any angle.

The lower the contrast gloss, the smaller the viewing-angle dependence of the gloss. Small values of contrast gloss make it possible to obtain a sufficient glossy sense even when the glossy fiber is processed into a structure with which the glossy sense of the material is generally less apt to appeal such as the woven or knit fabric formed by bending fibers. Such feature is observed especially when the contrast gloss is 2.0 or less. This range is hence more preferred. The lower the contrast gloss, the more the glossy fiber is preferred. However, a practical lower limit of the contrast gloss is 1.0.

It is preferable that the glossy fiber has a cross-section along a direction perpendicular to a fiber axis, the cross-section having an inscribed circle diameter $R_B$ (diameter of B in FIG. 1(*a*)) and a circumscribed circle diameter $R_C$ (diameter of C in FIG. 1(*a*)) for the fiber which have a relationship represented by $1.0 \leq R_C/R_B \leq 3.0$, in which $R_C/R_B$ represents the degree of non-circularity of the fiber.

The glossy fiber is not particularly limited in the cross-sectional shape thereof. The glossy fiber can have any of various cross-sectional shapes including complete circles such as those shown in FIGS. 2 (*a*) and 2(*b*) and FIGS. 4 (*a*) and 4(*b*), multi-leafed shapes such as those shown in FIGS. 1 (*a*) and 1(*b*) and FIGS. 3 (*a*) and 3(*b*), and other noncircular shapes including elliptic shapes, polygonal shapes, toothed-wheel shapes, petaloid shapes, and star shapes. Meanwhile, in a cross-sectional shape having a high degree of non-circularity, the light reflected by the fiber surface sometimes includes glaringness and a deep lustrous gloss is not observed depending on viewing angle. It is hence preferable that $R_C/R_B$, which represents the degree of non-circularity, is $1.0 \leq R_C/R_B \leq 3.0$. It is more preferable that $R_C/R_B$ is in the range of $1.0 \leq R_C/R_B \leq 2.0$, because not only the gloss peculiar to the fiber is more apt to be visually recognized but also satisfactory spinnability is obtained.

When the fiber is made to have a noncircular cross-section, it is preferable that the cross-section has a multi-leafed shape such as that shown in FIG. 1(*a*). The term "multi-leafed cross-section" means a cross-section having recesses and protrusions, the number of the recesses being equal to the number of the protrusions. Due to the presence of the recesses and protrusions, the incident light is less apt to be reflected in one direction and is diffused and reflected in various directions compared to circular cross-sections. Because of this, when this fiber is used to obtain a woven or knit fabric, a low contrast gloss is obtained, that is, a deep lustrous gloss having a small viewing-angle dependence is obtained.

The multi-leafed shape is not particularly limited in an upper or lower limit of the number of leaves. However, from the standpoint of obtaining a better lustrous gloss, it is preferable that the number of leaves is 3 or larger. Meanwhile, from the standpoint that spinnability and the cross-sectional shape can be made stable, the number of leaves is preferably 6 or less.

The glossy fiber preferably contains light-absorbing particles in an amount of 0.01-5.0 wt % in at least one polymer constituting the fiber, the light-absorbing particles having an average transmittance of 40% or less in the visible-light wavelength region.

The term "light-absorbing particles" herein means particles having an absorption wavelength range in the visible-light wavelength region. The expression "amount of the particles contained" means the weight of the particles present in the fiber that has not been subjected to any post-processing, e.g., dyeing, that is, in the fiber which has just been produced through spinning and drawing. The average transmittance of the light-absorbing particles can be evaluated using a spectrophotometer including an illuminant capable of measuring in the visible-light wavelength region such as a tungsten lamp. The term "average transmittance of the light-absorbing particles" herein means an average of transmittances of a solution obtained by evenly dispersing the particles in a concentration of 1.0 wt % in an appropriate medium, the transmittances being measured in the visible-light wavelength region at wavelength intervals of 10 nm.

Specifically, the solution obtained by evenly dispersing 1.0 wt % the particles in an appropriate medium is filled into a quartz glass cell, and the medium alone is filled into a quartz glass cell, thereby producing samples. Light is caused to strike on each sample at an incidence angle of 0° to determine the proportion of the transmitted-light intensity of the light-absorbing particle dispersion solution sample, with the transmitted-light intensity of the medium-alone sample being taken as 100. Values for the visible-light wavelength region (300 nm to 800 nm) are extracted from the values measured at wavelength intervals of 10 nm, and an average thereof is determined. Three measurements were made on the same sample and a simple number average of the results was determined. The number average was rounded off to the nearest tenth to obtain the average transmittance of the light-absorbing particles.

When at least one of the polymers constituting the glossy fiber contains light-absorbing particles in an amount in the range of 0.01-5.0 wt %, the light-absorbing effect of the particles can be exhibited without inhibiting the light reflection due to a fiber morphology. The inclusion thereof in such amount is hence preferred. A more preferred range thereof is up to 1.0 wt %, because the average reflectance required for the fiber can be attained without requiring a specific fiber morphology.

The closer the average transmittance of the particles to 0%, the more the light-absorbing effect can be enhanced. However, from the standpoint of obtaining a sufficient light-absorbing effect even when the amount of the particles added to the polymer is 5.0 wt % or less, it is preferable that the average transmittance of the particles in the visible-light wavelength region is 40% or less.

The light-absorbing particles contained in the glossy fiber are not particularly limited in the kind thereof. By changing the absorption wavelength range of the particles, the tint of the visible gloss can be changed. For example, with black particles which mainly absorb light having wavelengths shorter than 310 nm in the visible-light wavelength region, a silvery gloss is obtained. With ocherous particles that mainly absorb light having wavelengths shorter than 500 nm, a golden gloss is obtained. With reddish-orange particles which mainly absorb light having wavelengths shorter than 580 nm, a coppery gloss is obtained. A fiber containing the black particles, among those, and has a silvery gloss is preferred because dyeing the fiber in post-processing results in a metallic sense with higher deepness and this renders fibrous products of the glossy fiber usable in a wider range of applications.

The black particles are not particularly limited. Use can be made, for example, of functional particles such as carbon black that absorbs not only light in the visible-light wavelength region, but also light in the infrared wavelength region and imparts heat storage properties, and perylene black, that reflects light in the infrared wavelength region and imparts heat-insulating properties. Such functional particles are more preferred because the use thereof can impart further functions to the glossy fiber.

It is preferable that at least one of the polymers constituting the glossy fiber contains air voids, the number density thereof in a cross-section of the fiber along a direction perpendicular to the fiber axis being 5.0 voids/$\mu m^2$ or higher. This is because the air voids can have the effect of irregularly reflecting light, making it possible to obtain a glossy fiber that sufficiently satisfies the required ranges of average reflectance and contrast gloss. When the air voids are regulated to have a diameter d of 10 nm$\leq$d$\leq$1,000 nm, such air voids are easy to form and are less apt to be defects leading to a decrease in the mechanical properties of the fiber. That range is hence more preferred.

The term "number of air voids" herein means a value determined in the following manner. A cross-section of a filament of the fiber which is perpendicular to the fiber axis is photographed with a transmission electron microscope (TEM) or a scanning electron microscope (SEM) at such a magnification that a hundred or more air voids can be observed. The number of air voids present in the image is divided by the area of the cross-section of the fiber appearing in the two-dimensional photograph image, this quotient being calculated down to the second decimal place and rounded off to the nearest tenth. This operation is performed on ten portions of any cross-section of the fiber, and a simple number average of the results is determined. The number average is rounded off to the nearest tenth to obtain the number density of air voids.

The term "diameter of the air voids" means a value obtained from the measured diameters of a hundred air voids arbitrarily extracted from the same image as that obtained by the photographing described above. The air voids appearing in a cross-section perpendicular to the fiber axis are not always complete circles. In an air void that is not a complete circle, the area thereof is determined to convert the shape of the air void into a circle and a diameter value thereof is employed. These values are measured in the unit nm down to the first decimal place and rounded off to the nearest whole number. Namely, the diameter of air voids is determined by measuring the diameter of each of a hundred air voids and determining a simple number average thereof.

Methods of forming air voids are not limited, and use can be made of various methods including: a method in which the melt spinning which will be described later is performed so that hollows are formed during the ejection; and a method in which an ingredient soluble in either hot water or an alkali is incorporated into a fiber and is dissolved away. However, the method in which an incorporated ingredient is dissolved away is preferred from the standpoint that a large number of fine air voids can be easily formed by this method. As the ingredient to be dissolved away, use may be made, for example, of poly(ethylene glycol) which is easy to dissolve away with water, a 5-sodiumsulfoisophthalic acid copolyester which is easy to dissolve away with alkalis, polystyrene which is easy to dissolve away with organic solvents or the like. Use of such ingredients is preferred because air voids can be easily formed not only in polymers from which dissolution is easy such as polyamide-based and polypropylene-based polymers, but also in polyester-based polymers, from which dissolution is difficult.

It is important that the average reflectance, average transmittance, and contrast gloss of the glossy fiber, in the visible-light wavelength region, should be in the specific ranges, and the glossy fiber is not limited in the sectional shape or components thereof. However, from the standpoint of maximizing the effect of light absorption and reflection to result in a deeper lustrous gloss, it is preferable that, as shown in FIG. 1(*a*), the cross-section of the glossy fiber along the direction perpendicular to the fiber axis includes a light absorption region (E in FIG. 1(*a*)) containing light-absorbing particles and a light reflection region (F in FIG. 1(*a*)) containing no light-absorbing particles. Due to the disposition of the light reflection region containing no light-absorbing particles, the probability that the light reflected by the light reflection region is absorbed by light-absorbing particles can be reduced, enabling the fiber to sufficiently exhibit the effect of absorbing and reflecting light.

In the cross-section of the fiber perpendicular to the fiber axis, the light absorption region is not particularly limited in the cross-sectional shape thereof. However, from the standpoint shown below, it is preferable that, as shown in FIG. 1(*a*), the light absorption region is the core of a core/sheath structure and the core lies on the fiber center (A in FIG. 1(*a*)). The term "fiber center" herein means the intersection of any two straight lines which each divide the cross-section of the fiber perpendicular to the fiber axis into two portions equal in area.

When the core is the light absorption region, incident light first passes through the light reflection region as the sheath and it is hence possible to minimize the reflectance-lowering effect of the light-absorbing particles. Meanwhile, from the standpoint of reducing the viewing-angle dependence of the light-absorbing effect so that a woven or knit fabric formed from the glossy fiber does not have unevenness in color, it is preferable that the core lies on the fiber center. The core is not limited in the shape thereof, and can have any of various shapes including complete circles such as those shown in FIGS. 2 (*a*) and 2(*b*) and FIGS. 4 (*a*) and 4(*b*), multi-leafed shapes such as those shown in FIGS. 1 (*a*) and 1(*b*) and FIGS. 3 (*a*) and 3(*b*), and other noncircular shapes including elliptic shapes, polygonal shapes, toothed-wheel shapes, petaloid shapes, and star shapes.

It is preferable that the circumscribed circle diameter $R_C$ (diameter of C in FIG. 1(*a*)) of the fiber and the circumscribed circle diameter $R_D$ (diameter of D in FIG. 1(*a*)) of the light absorption region have a relationship represented by $0.3 \leq R_D/R_C \leq 1.0$, because the light-absorbing effect of the fiber can be further enhanced. As $R_D/R_C$ approaches 1, the probability that the light which has passed through the light reflection region passes through the light absorption region increases to enhance the light-absorbing effect. It is hence possible to make the fiber have a deeper lustrous gloss.

Furthermore, when $R_D/R_C$ is $0.6 \leq R_D/R_C \leq 1.0$, that effect can be maximized. This range is hence more preferred. When the cross-section of the fiber perpendicular to the fiber axis is regulated so that the areal proportion of the light absorption region therein is 20% or less, while satisfying that range of $R_D/R_C$, then the light-absorbing effect can be enhanced without lessening the light-reflecting effect of the light reflection region. This configuration is hence more preferred. However, from the standpoint that spinnability and the cross-sectional shape can be made stable, a lower limit of the areal proportion of the light absorption region is 1%.

To further enhance the gloss peculiar to the glossy fiber, it is important that the average reflectance should be high. Examples of techniques for heightening the average reflectance include to introduce interfaces between substances differing in refractive index into the fiber. This is based on the property of light by which it is reflected by an interface between substances differing in refractive index. The larger the difference in refractive index, the higher the reflection at the interface. Such interfaces may be attained by using polymers of different kinds in combination. It is preferable in the glossy fiber that the light reflection region in the cross-section of the fiber perpendicular to the fiber axis includes two or more kinds of polymers.

The term "polymers of different kinds" herein means not only polymers different in basic composition, but also polymers equal in basic composition, but different in comonomer ingredients or components. From the standpoints of inhibiting interlaminar separation and obtaining a satisfactory composite cross-section, it is more preferable that all the polymers to be used in combination belong to the same polymer group. By using polymers belonging to the same polymer group, a high interfacial affinity can be imparted to obtain a fiber which does not suffer separation.

The composite structure in the glossy fiber is not particularly limited so long as the structure includes an interface between polymers, like a core/sheath structure, a sea/island structure, a multilayer structure or the like. It is, however, preferable that any two polymers for constituting a light reflection region are disposed to form a concentric alternating multilayer structure such as that configured of G and H in FIG. 1(*b*). This is because enhanced light reflection is attained by the increased amount of interfaces due to the superposition and because by controlling the thickness of each of the superposed layers, a fiber which has a coloration due to structural coloring by the interference of reflected light, as in International Publication WO 1998/46815, and which has an optical control function such as ultraviolet/infrared reflection, is obtained.

The term "concentric alternating multilayer structure" herein means a structure made up of layers superposed, like annual rings, outward from the center of the fiber to have the same center of gravity. By concentrically disposing the layers, substantially the same effect of reflection and interference is generally obtained from any position around each filament. Namely, a reduction in viewing-angle dependence is attained. The concentric structure is hence preferred when the glossy fiber is formed into three-dimensional products through sewing, as in garment applications.

It is preferable that the number of superposed layers in the concentric alternating multilayer structure is 5 or larger, because the effect of light reflection and interference can be sufficiently obtained without imposing considerable limitations on polymer combinations.

The term "number of superposed layers" herein means the total number of layers of the alternating multilayer structure lying on a straight line (J in FIG. 1(*b*)) drawn from any point (I in FIG. 1(*b*)) on the outermost layer of the cross-section of the fiber perpendicular to the fiber axis to the fiber center (A in FIG. 1(*b*)). This number of superposed layers simply correlates with the effect of light reflection and interference. The larger the number thereof, the higher the effect. Although the total number of superposed layers can be designed at will, a practical upper limit thereof is 150 from the standpoint of ensuring satisfactory feeling and mechanical properties including wear resistance, which is a desired effect.

When an interface having a larger difference in refractive index is to be obtained relatively easily to further heighten the average reflectance, it is preferable that air, which has a refractive index of 1.0, is present in a polymer, in view of the fact that polymers can have refractive indexes of about 1.3-1.8. Namely, it is preferable that any of the polymers constituting the light reflection region of the fiber has air voids therein. In this example, when the polymer having air voids is disposed as inner layers (H in FIG. 1(*b*)) of a multilayer structure and a polymer having no air voids is disposed as outer layers (G in FIG. 1(*b*)) thereof, then not only the air voids evenly present in the polymer of the inner layers produce the effect of lowering the refractive index of the layers as a whole, thereby giving both the structural coloring due to the interference of reflected light and optical control functions such as ultraviolet/infrared reflection, as described above, but also the presence of the outer layers, which have no air voids, improves the wear resistance and coloration of the fiber. Such a multilayer structure is hence preferred.

It is more preferable that polymers differing in refractive index are used for the outer layers and inner layers so that the polymer having a higher refractive index is used to form the outer layers and the polymer having a lower refractive index is used to form the inner layers. Thus, interfacial reflection due to the difference in refractive index between the polymers is added. The optical control functions of the multilayer structure can hence be further enhanced.

From the standpoint of imparting a satisfactory feeling to a woven or knit fabric to be formed from the glossy fiber, the fiber preferably has a single-filament fineness of 5 dtex or less. In particular, when the single-filament fineness thereof is 3 dtex or less, such range not only is more suitable for products which come into contact with the skin such as inner wear, shirts, and blouses, but also is a more preferred range also from the standpoint that fabrics formed from this fiber have an increases amount of interstices among the fibers to show enhanced diffuse reflection, thereby having a high gloss and producing a glaringness-inhibiting effect.

The term "single-filament fineness dtex" herein means a value determined by measuring the weight per unit length of the fiber multiple times to obtain an average value thereof, calculating the weight per 10,000 m from the average value, and dividing the calculated value by the number of filaments of the fiber.

However, when the single-filament fineness thereof is less than 0.01 dtex, not only such a fiber is difficult to produce but also the too small fiber diameter results in enhanced diffuse reflection so that when a material including the glossy fiber is, for example, dyed and used as a colored material, this colored material is presumed to have a reduced apparent coloration. A lower limit of the single-filament fineness is hence 0.01 dtex.

A fibrous product, at least a part of which is constituted of the glossy fiber, has the deep lustrous gloss and can be processed into woven or knit fabrics suitable for garment applications. Owing to this, the fibrous product can be extensively used in garment/apparel applications including general garment applications such as inner and outer wear and interior applications such as curtains and cloths. From the standpoint that functions can be imparted by controlling the cross-sectional structure of the fiber or the particles to be contained, the fibrous product is suitable for use not only in apparel applications but also in sportswear and industrial material applications. When the cross-section of the glossy fiber is configured of at least three different polymers, preferred configurations of the composite cross-section are described below in detail.

It is preferable in the glossy fiber that the cross-section of the fiber is configured of at least three different kinds of polymers and the cross-section includes a multilayer region formed by two of the three polymers and a non-multilayer region formed by the remaining polymer. The term "different kinds of polymers" herein means not only polymers which differ in composition but also polymers which are equal in basic composition but differ in comonomer ingredients, blending ingredients, or contained particles.

From the standpoint of production efficiency and the like, it is preferable that the glossy fiber is produced by melt spinning, which will be described later. Suitable polymers are thermoplastic polymers. The term "thermoplastic polymers" herein means polymers belonging to polymer groups respectively based on polyesters, polyethylene, polypropylene, polystyrene, polyamides, polycarbonates, poly(methyl methacrylate), poly(phenylene sulfide) and the like. Especially from the standpoints which will be shown later, it is preferable that all the thermoplastic polymers to be used for the glossy fiber are polymers belonging to the same polymer group.

It is preferable that the multilayer region of the glossy fiber is formed from two kinds of polymers to impart the peculiar gloss.

The term "multilayer region" herein means a region where layers of a first polymer have been alternately superposed with layers of a second polymer to form a multilayer structure.

With respect to the two kinds of polymers superposed, the basic point is that interfaces between the different polymers have been stacked in a multilayer arrangement to thereby attain light reflection and that the superposed polymers are different kinds of polymers. Although a lustrous gloss can be attained by the light reflection due to the superposed layers and light absorption due to a non-multilayer region, a glossy fiber further having an advanced function such as structural coloring due to the interference of reflected light, is obtained by controlling the thickness of each of the layers to be superposed. For this reason, it is preferable that the cross-section of the glossy fiber has a multilayer structure made up of alternately superposed polymers differing in refractive index.

The term "refractive index of a polymer" herein means a value obtained by averaging the refractive index of the polymer itself and the refractive indexes of other components, voids, particles and the like contained in the polymer. The difference in refractive index is preferably 0.05 or larger, more preferably 0.1 or larger. When there is such a refractive-index difference, higher light reflection/interference properties can be obtained and the fiber obtained can have a more lustrous gloss and a more visible coloration caused by structural coloring. However, in view of the refractive indexes (1.0-2.0) which polymers can have, a practical upper limit of the difference in refractive index is 1.0.

It is preferable that in the multilayer region of the glossy fiber, different kinds of polymers have been concentrically superposed. The term "concentric superposition" herein means a structure made up of layers superposed, like annual rings, outward from the center of the fiber to have the same center of gravity such as K and L in FIGS. 5 and 6.

When the alternating multilayer structure is concentric, substantially the same effect of reflection and interference is generally obtained from any position around each filament. Namely, a reduction in viewing-angle dependence is attained. The concentric structure is hence preferred in cases when the glossy fiber is formed into three-dimensional products through sewing, as in garment applications. The alternating multilayer structure may have any of various concentric configurations including concentric circular shapes (e.g., K and L in FIG. 5), concentric elliptic shapes (e.g., K and L in FIG. 6), and other concentric noncircular shapes including concentric triangular shapes, concentric Y-shapes, and concentric star shapes.

When the fiber is formed so that the cross-section is a complete circle, not only the viewing-angle dependence can be further reduced, but also the fiber can give a fabric with a good touch. It is hence more preferable that the alternating multilayer structure is concentric.

In the multilayer region of the glossy fiber, the single-layer thickness is preferably 0.01 μm to 1.0 μm. The reasons therefor are as follows.

In forming the multilayer region of the glossy fiber, the thickness of each layer in the multilayer region is controlled on the basis of the following theory of multilayer thin-film interference. Thus, it is possible to obtain a glossy fiber which not only has a lustrous gloss due to interlaminar light reflection but also functions to cause the interference and reflection of light having any desired wavelength range.

$$4nd=(2m-1)\cdot\lambda \qquad \text{Equation (1)}$$

n: average refractive index of the two polymers d: average layer thickness (nm) of the two polymers m: any integer (1, 2 • • • )

λ: interference wavelength (nm)

It is known that control of interference wavelength can be attained by regulating the thickness (d) of superposed layers to satisfy equation (1) containing a desired interference wavelength λ, and that the smaller the value of m, the narrower the wavelength range where intense interference and reflection occurs.

When the thickness (d) of superposed layers in Equation (1) is selected so that m is 1-3, intense interference and reflection occurs in a narrow wavelength range. In this example, when λ, is set at a value in the visible-light wavelength region (350 nm to 780 nm), a highly visible coloration due to structural coloring is obtained, and when λ, is set at 350 nm or less or at 780 nm or above, a glossy fiber causing the interference and reflection of ultraviolet light or infrared light, respectively, is obtained. Meanwhile, when the thickness (d) of superposed layers is selected so that m is larger than 4, multiple interference occurs to cause interference and reflection over a wide wavelength range including the ultraviolet, visible-light, and infrared regions.

From the standpoint shown above, the alternating multilayer structure included in the multilayer region in the cross-section of the glossy fiber preferably is one in which the single-layer thickness is 1.0 μm or less, resulting in the refractive indexes n of the polymers of 1-2, interference wavelengths to be visible-light wavelengths and m of 3 or less, for the purposes of attaining a lustrous gloss and producing excellent structural coloring. More preferably, the single-layer thickness is 0.4 μm or less, which results in m of 2 or less, which enhances the structural coloring. This idea leads to a feature in which the smaller the single-layer thickness, the smaller the value of m, making it possible to attain a more visible coloration due to structural coloring. It is hence especially preferred to set the single-layer thickness at 0.01 μm or larger. When the single-layer thickness is in such range, the cross-section is stable and high production efficiency can be ensured.

The number of superposed layers in the multilayer region in the glossy fiber is preferably 5 or larger, because the effect of light reflection and interference can be sufficiently obtained without imposing considerable limitations on polymer combinations. The term "number of superposed layers" herein means the total number of layers of the multilayer structure within the multilayer region which lie on a straight line (N in FIG. 5) drawn from any point (O in FIG. 5) lying in the multilayer region and on the outermost layer of the cross-section of the fiber to the fiber center (A in FIG. 5).

The number of superposed layers simply correlates with the effect of light reflection and interference. The larger the number thereof, the higher the effect. The number of superposed layers is hence more preferably 15 or larger. Although the total number of superposed layers can be designed, a practical upper limit is 150 from the standpoint of ensuring satisfactory feeling and mechanical properties including wear resistance.

It is preferable that the non-multilayer region of the glossy fiber is formed from a polymer different from the polymers constituting the multilayer region.

As described above, it is important, for imparting a metallic gloss to each filament, that both a multilayer region, which serves to reflect light, and a non-multilayer region, which serves to absorb light, should be present in the cross-section of the fiber. A basic point is that the non-multilayer region is constituted of a polymer different from the polymers of the multilayer region, which serves to reflect light, for the purpose of light absorption.

However, from the standpoint of effectively producing the effect of absorbing light, it is preferred to use either a polymer containing a light-absorbing ingredient or a polymer in which an ingredient that reacts with a light-absorbing ingredient has been copolymerized. The term "light-absorbing ingredient" herein means an ingredient having an absorption wavelength range in at least some of the visible-light region. When the light-absorbing ingredient is an ingredient which absorbs light having all the wavelengths throughout the visible-light region such as, for example, carbon black, not only a fabric formed from the glossy fiber can be highly inhibited from emitting stray light due to irregular reflection at fiber-fiber interstices but also the effect of structural coloring due to the reflection and interference of light by the alternating multilayer structure of the multilayer region can be enhanced. Use of such a light-absorbing ingredient is hence more preferred.

The areal proportion of the multilayer region to the non-multilayer region in the glossy fiber is preferably 50/50 to 95/5. Increasing the proportion of the area occupied by the multilayer region enhances the light reflection/interference effect produced by the multilayer region. The areal proportion hence is preferably 50/50 or higher, more preferably 80/20 or higher. Meanwhile, by regulating the areal proportion to 95/5 or less, the light-absorbing effect of the non-multilayer region can be obtained and ejection stability during fiber formation and a composite cross-section having no abnormality can be ensured.

The cross-sectional structure of the multilayer region and non-multilayer region in the glossy fiber can be a structure in which the multilayer region is concentrically superposed circular layers and the non-multilayer region is a central circle such as that shown in FIG. 7(*a*). However, a structure in which a multilayer region has been divided by a non-multilayer region such as, for example, that shown in FIGS. 1 (*a*) and 1(*b*), is preferred because the light-absorbing effect has a reduced viewing-angle dependence. More preferred is a configuration in which the non-multilayer region lies on the fiber center. The number of divided portions is preferably 2 or larger, and is more preferably 3 or larger from the standpoint of reducing the difference in appearance between fibers. From the standpoints of ensuring the stability of the cross-section and rendering stable production possible, a practical upper limit of the number of divided portions is 30.

From the standpoints of inhibiting interlaminar separation and obtaining a satisfactory composite cross-section, it is more preferable that all the polymers constituting the multilayer region and non-multilayer region are polyester-based polymers. Especially preferred in the multilayer region is a configuration including a first polymer that is poly(ethylene terephthalate) or poly(ethylene naphthalate), which has a high refractive index, and a second polymer that is poly (lactic acid), which has a low refractive index, a polyester-based polymer containing a low-refractive-index ingredient, e.g., air, or a polyester-based polymer in which an ingredient having no aromatic ring such as cyclohexanedicarboxylic acid or 1,4-cyclohexanedimethanol, has been copolymerized.

By thus using polyester-based polymers belonging to the same group as poly(ethylene terephthalate) and poly(ethylene naphthalate), as the first and second polymers, a high interfacial affinity can be imparted. Because of this, the alternating multilayer structure thus formed makes it possible to obtain a glossy fiber which, due to the high interfacial affinity, does not suffer interlaminar separation even without a protective layer.

An example of processes of producing our glossy fiber is described below in detail. 0

A preferred process of producing a glossy fiber is melt spinning, from the standpoint of heightening the production efficiency. When the glossy fiber includes two or more polymers, this glossy fiber can be produced by using a complex spinneret which will be described later. The spinning temperature is a temperature at which mainly the high-melting-point or high-viscosity polymer, among the polymers to be used, is flowable. The temperature at which the high-melting-point or high-viscosity polymer is flowable, although varying depending on the molecular weight, may be set at a temperature between the melting point of the polymer and the melting point plus 60° C. Such temperatures enable stable production.

The spinning speed may be about 500-6,000 m/min, and can be changed in accordance with the properties of the polymers and the intended use of the fiber. In particular, from the standpoint of highly orienting the polymers to improve the mechanical properties, it is preferred to use a spinning speed of 500-4,000 m/min and then draw the filaments, because the uniaxial orientation of the fiber can be promoted. It is preferable that in preparation for the drawing, a preheating temperature is properly set at a temperature capable of softening, e.g., the glass transition point of a polymer. An upper limit of the preheating temperature is preferably a temperature at which the filaments being running are not disordered by the spontaneous extension of the fiber. For example, in the case of PET having a glass transition temperature around 70° C., the preheating temperature is usually set at about 80-95° C.

In producing the glossy fiber, the ejection rate per spinneret hole may be about 0.1-10 g/min per hole, which renders stable production possible. The ejected polymer streams are cooled and solidified, and an oil is then applied thereto. The filaments are subsequently taken up by a roller which is rotating at a given peripheral speed. Thereafter, the filaments are drawn with heated rollers to obtain the desired glossy fiber.

When the glossy fiber includes two or more polymers, it is preferable that the polymers to be used are ones which have a melt viscosity ratio less than 2.0 and a difference in solubility parameter less than 2.0. This is because use of such polymers enables stable formation of composite polymer streams and can yield a fiber having a satisfactory composite cross-section.

Figure 10:
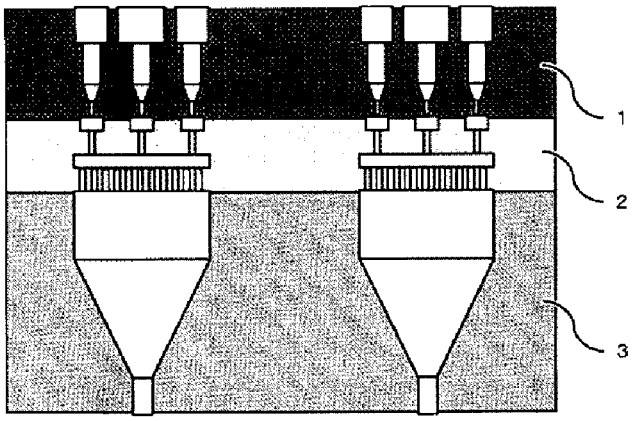
FIG. 10 is a cross-sectional view of a spinneret illustrating a method of producing our fiber.

As a complex spinneret for use when the glossy fiber includes two or more polymers, it is preferred to use the complex spinneret described in JP-A-2011-208313. The complex spinneret shown in FIG. 10 in the accompanying drawings is roughly configured of three members, i.e., a metering plate 1, a distribution plate 2, and an ejection plate 3, that have been stacked in this order from the upper side, and is incorporated in this state into a spinning pack and used for spinning. FIG. 10 shows an example in which three polymers, polymers A, B, and C, are used. With any of conventional complex spinnerets, it is difficult to composite three or more polymers. It is after all preferred to use a composite spinneret in which fine channels are utilized such as that shown in FIG. 10.

The spinneret members shown in FIG. 10 serve as follows. The metering plate 1 serves to supply the polymers while metering the polymers for each ejection hole and for each distribution hole. The distribution plate 2 controls the composite cross-section of each filament and the cross-sectional shape thereof. The ejection plate 3 compresses each composite polymer stream formed in the distribution plate 2 and ejects the compressed stream.

With respect to members to be stacked over the metering plate 1, use may be made of members in which channels have been formed in accordance with the spinning machine and spinning pack, although such members are not shown in the figure to avoid a complicated ex-planation on the complex spinneret. By designing a metering plate 1 so that the metering plate 1 fits with existing channel members, the existing spinning pack and members thereof are rendered usable as such. There is hence no need of using a spinning machine exclusively for the spinneret. Practically, it is desirable to dispose a plurality of channel plates between the channels and the metering plate or between the metering plate 1 and the distribution plate 2. This is intended to produce a configuration which includes channels for efficiently transferring the polymers in cross-sectional directions of the spinneret and in cross-sectional directions of each filament before introducing the polymers into the distribution plate 2. The composite polymer streams ejected from the ejection plate 3 are cooled and solidified, thereafter coated with an oil, and taken up by a roller which is rotating at a given peripheral speed, in accordance with the process shown above. Thereafter, the filaments are drawn with heated rollers to obtain a desired glossy fiber.

High-order processing of producing a fibrous product from the glossy fiber is not particularly limited. The fibrous product can have a deep lustrous gloss produced by an intense glossy sense coupled with a gloss having fascinating shades and shadows due to ruggedness, even when the fibrous product is a structure formed by bending the fiber, in which the glossy sense of the material is generally less apt to appeal.

When the fiber has been made to have optical parameters including an average reflectance of 40% or higher, an average transmittance of 20% or less, and a contrast gloss of 2.0 or less, the fibrous product produced therefrom in which the fiber is in a highly bent state such as a hard twist yarn, spun yarn, or nonwoven fabric, can have a sufficient glossy sense. Use of the fiber having such optical parameters is hence preferred.

EXAMPLES

Our glossy fiber is explained below in detail by reference to Examples.

The Examples and Comparative Examples were evaluated for the following properties.

A. Melt Viscosity of Polymer

A polymer in the form of chips was dried with a vacuum dryer to a water content of 200 ppm or less and examined for melt viscosity with a capillograph manufactured by Toyo Seiki Ltd., while stepwisely changing the strain rate. The measurement was made at the same temperature as the spinning temperature in a nitrogen atmosphere. The period from sample introduction into a heating oven to initiation of the measurement was set at 5 minutes. The value measured at a shear rate of 1,216 $s^{-1}$ was taken as the melt viscosity of the polymer.

B. Refractive Index of Polymer

A measurement was made in accordance with JIS K7142 (1996), method A.

C. Fineness

A fiber having a length of 100 m was weighed, and the measured value was multiplied by 100. This operation was repeatedly performed 10 times, and an average thereof was rounded off to the nearest tenth. The rounded value was taken as the fineness (dtex). Dividing the fineness by the number of filaments gives single-filament fineness (dtex).

D. Cross-Section Parameters ($R_C/R_B$, $R_D/R_C$)

A fiber was cut perpendicularly to the axis direction of the fiber, and the cross-section of the fiber was examined with a scanning electron microscope (SEM) manufactured by HITACHI, at any desired magnification, at a magnification of 500-80,000 times, at which the whole cross-section lay in the field of view. The photograph obtained was subjected to image analysis using computer software WinROOF, manufactured by Mitani Corp., to thereby calculate a ratio, $R_C/R_B$, between the inscribed circle diameter $R_B$ (e.g., the diameter of B in FIG. 1(*a*)) and circumscribed circle diameter $R_C$ (e.g., the diameter of C in FIG. 1(*a*)) of the glossy fiber. This examination was conducted three times per filament, and ten filaments were thus examined and a simple number average of the results was determined. The average was rounded off to the nearest tenth, and this rounded value was taken as $R_C/R_B$.

When the cross-section of the fiber included a light absorption region (e.g., E in FIG. 1(*a*)) containing light-absorbing particles and a light reflection region (e.g., F in FIG. 1(*a*)) containing no light-absorbing particles, a calculation was also made to determine a ratio, $R_D/R_C$, between the circumscribed circle diameter $R_C$ (e.g., the diameter of C in FIG. 1(*a*)) of the glossy fiber and the circumscribed circle diameter $R_D$ (e.g., the diameter of D in FIG. 1(*a*)) of the light absorption region. This examination was conducted three times per filament, and ten filaments were thus examined and a simple number average of the results was determined. The average was rounded off to the nearest hundredth, and this rounded value was taken as $R_D/R_C$.

E. Average Transmittance of Additive Particles

A solution obtained by evenly dispersing 1.0 wt % additive particles in an appropriate medium was filled into a quartz glass cell, and the medium alone was filled into a quartz glass cell, thereby producing samples. Using spectrophotometer Type U-3010, manufactured by HITACHI, light was caused to strike on each sample at a light incidence angle of 0° to determine the proportion of the transmitted-light intensity of the additive particle dispersion solution sample, with the transmitted-light intensity of the medium-alone sample being taken as 100. Values for the visible-light wavelength region (300 nm to 800 nm) were extracted from the values measured at wavelength intervals of 10 nm, and an average thereof was calculated. This operation was performed three times per portion, and ten portions in total were thus examined to determine a simple number average of the results. The average was rounded off to the nearest tenth, and this rounded value was taken as the average transmittance of the additive particles.

F. Number Density and Diameter of Air Voids in Fiber Cross-Section

In a fiber having air voids therein, the number of air voids was determined in the following manner. A cross-section of the glossy fiber was produced by the BIB 2 method (cooling) and was then coated with fine metal particles by sputtering. This cross-section sample was examined with field-emission scanning electron microscope (FE-SEM) SU8020, manufactured by Hitachi High-Technologies, under the conditions of an accelerating voltage of 1.5 kV at such a magnification, in the range of 5,000-1,000,000 times, that a hundred or more air voids were able to be observed. The photograph obtained was digitized. This photograph of the cross-section was subjected to image analysis using computer software WinROOF, manufactured by Mitani Corp. The number of air voids present in the image was divided by the area of the fiber cross-section appearing in the two-dimensional photograph image, this quotient being calculated down to the second decimal place and rounded off to the nearest tenth. This operation was performed on ten portions of any cross-section of the fiber, and a simple number average of the results was determined. The number average was rounded off to the nearest tenth, and the rounded value was taken as the number density of air voids.

Meanwhile, the diameter of air voids was determined in the following manner. A hundred air voids were arbitrarily extracted from the same image as that obtained by the photographing described above, and the diameter of each of these air voids was measured in the unit nm down to the first decimal place. A simple number average of the diameters of the air voids was determined and rounded off to the nearest whole number. The rounded value was taken as the diameter of the air voids. In the case where air voids appearing in the cross-section perpendicular to the fiber axis were not complete circles, diameter values determined through a measurement of the areas thereof and conversion into circles were employed.

G. Optical Parameters (Average Reflectance, Average Transmittance, Contrast Gloss)

A plain weave fabric was produced while regulating the number of fibers so that the warp density was equal to the weft density and the cover factor (CF) was 1,100. The cover factor (CF) used herein is a value determined, in accordance with JIS-L-1096:2010 8.6.1, by determining the density of the fabric through an examination of a 2.54 cm area and calculating the cover factor using the equation: cover factor (CF)=(weft density)×(weft fineness)½. With respect to the plain weave fabric obtained, three optical parameters, i.e., average reflectance, average transmittance, and contrast gloss, were calculated in the following manners.

First, the average reflectance was determined as follows. Using a spectrophotometer (UV-3100 PC Series) manufactured by SHIMADZU, each sample was examined for relative diffuse reflectance (including specular reflection) at a light incidence angle of 8°, with the reflection on a standard white board ($BaSO_4$) being taken as 100. Reflectance values for the visible-light wavelength region (300 nm to 800 nm) were extracted from the reflectance values measured at wavelength intervals of 10 nm, and an average thereof was calculated. This operation was performed three times per portion, and ten portions in total were thus examined. A simple number average of the results was determined and rounded off to the nearest whole number. The rounded value was taken as the average reflectance.

The average transmittance was determined as follows. Using a spectrophotometer (UV-3100 PC Series) manufactured by SHIMADZU, each sample was examined, at a light incidence angle of 0°, for the proportion of the reflection on a standard white board ($BaSO_4$), which was taken as 100, in the light transmitted through the sample. Values for the visible-light wavelength region (300 nm to 800 nm) were extracted from the values measured at wavelength intervals of 10 nm, and an average thereof was calculated. This operation was performed three times per portion, and ten portions in total were thus examined. A simple number average of the results was determined and rounded off to the nearest whole number. The rounded value was taken as the average transmittance.

Next, the contrast gloss was determined as follows. Using an automatic gonio-photometer (GONIOPHOTOMETER TYPE GP-200) manufactured by Murakami Color Research Laboratory, light was caused to strike on each sample at an incidence angle of 60° to determine light intensity over the light-receiving angle range of 0°-90° at intervals of 0.1° through a two-dimensional reflected-light distribution measurement. A maximum light intensity (specular reflection), observed at around a light-receiving angle of 60°, was divided by a minimum light intensity (diffuse reflection), observed at around a light-receiving angle of 0°. This operation was performed three times per portion, and ten portions in total were thus examined. A simple number average of the results was determined and rounded off to the nearest tenth. The rounded value was taken as the contrast gloss.

H. Glossy Sense

Under the illumination with a given quantity of light, the plain weave fabric produced in G. above was visually examined for glossy sense by five examiners. The glossy sense was evaluated in the following three grades.

Excellent: having an exceedingly deep, lustrous gloss.

Good: having a deep lustrous gloss.

Poor: not having a deep lustrous gloss.

I. Feeling (Touch and Softness)

The plain weave fabric produced in G. above was examined for feeling to touch by five examiners, and the feeling was evaluated in the following four grades.

Excellent: having excellent feeling.

Good: having good feeling.

Fair: usable in garment applications.

Poor: having poor feeling.

J. Heat-Insulating Property

A sheet of black drawing paper was placed tightly on a styrene foam base, and a temperature sensor was fixed to a central portion of the surface of the black drawing paper. Thereafter, a test fabric of 20×20 cm was cut out from the plain weave fabric produced in G. above, and was set, with the fixing surface facing downward. In a 20° C. 65% RH environment, the test fabric was then irradiated for 5 minutes with light from a 300-W halogen lamp placed just above the test fabric at a distance of 50 cm therefrom, and the temperature increase ΔT was measured after the 5 minutes. A simple number average of the results was determined and rounded off to the nearest tenth. The rounded value was taken as the heat-insulting property.

K. Composite Cross-Section (Number of Superposed Layers and Thickness of Superposed Layers)

A fiber was cut at any position along the axis direction of the fiber, and the cross-section of the fiber was examined with a scanning electron microscope (SEM) manufactured by HITACHI to determine the number of superposed layers and the thickness of the superposed layers. The terms "number of superposed layers" and "thickness of the superposed layers" herein respectively mean the total number of superposed layers in the multilayer structure of a multilayer region and the thickness of each of the superposed layers, the superposed layers being layers lying on a straight line (N in FIG. 5) drawn from any point (0 in FIG. 5) within the multilayer region lying on the outermost layer of the cross-section of the fiber to the fiber center (A in FIG. 5). This operation was performed on ten portions, and averages of the results obtained were taken as the number of superposed layers and the thickness of the superposed layers.

L. Composite Cross-Section (Areal Ratio and Number of Divided Portions)

Figure 5:
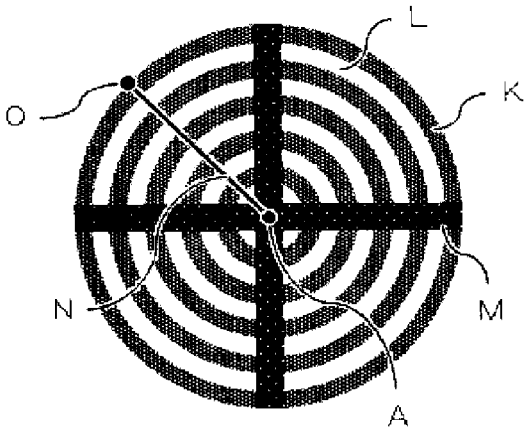
FIG. 5 is a diagrammatic view of the cross-sectional structure of a glossy fiber.

A fiber was cut at any position along the axis direction of the fiber, and the cross-section of the fiber was examined with a scanning electron microscope (SEM) manufactured by HITACHI to determine the areal ratio between the multilayer region and the non-multilayer region and the number of divided portions in the multilayer region. The term "areal ratio between the multilayer region and the non-multilayer region" herein means {total area of two kinds of polymers (area of portions K and L in FIG. 5) constituting the multilayer region}/{total area of other polymer(s) (area of portion M in FIG. 5) constituting the non-multilayer region}. The term "number of divided portions in the multilayer region" means the number of multilayer-region portions into which the multilayer region in the fiber cross-section is divided upon removal of the non-multilayer region. In FIG. 5, for example, the number of divided portions is 4.

M. Structural Coloring

A fiber sample was produced by arranging fifty multifilament yarns of a fiber in parallel with each other on a black plate without leaving a space between the yarns. Under the illumination with a given quantity of light, the fiber sample obtained was visually examined for structural coloring by five examiners. The structural coloring was evaluated in the following four grades.

Excellent: intense structural coloring occurred.

Good: structural coloring occurred.

Fair: slight structural coloring occurred.

Poor: no structural coloring occurred.

Example 1

Prepared were: poly(ethylene terephthalate) containing 0.5 wt % carbon black particles (average transmittance, 0.1%) (0.5 wt % CB-containing PET; melt viscosity, 120 Pa·s) as polymer 1; poly(ethylene terephthalate) (PET; melt viscosity, 120 Pa·s) as polymer 2; and poly(ethylene terephthalate) alloyed with 10 wt % poly(ethylene glycol) (10 wt % PEG-alloyed PET; melt viscosity, 40 Pa·s).

These polymers were separately melted at 290° C. and then introduced into a spinning pack including the complex spinneret shown in FIG. 10 in such a proportion that the polymer 1/polymer 2/polymer 3 ejection ratio was 10/45/45 in terms of areal ratio in the fiber cross-section. The introduced polymers were ejected from each ejection hole to result in a composite configuration which had a three-leafed composite cross-sectional shape of fiber such as that shown in FIG. 1(*b*) and in which the number of superposed layers was 10. Through this ejection, the polymers were disposed so that a Y-shaped core made of polymer 1 was a light absorption region and a sheath constituted of a concentric alternating multilayer structure including polymer 2/polymer 3/polymer 2/ • • • , with the outermost layer being polymer 2, was a light reflection region.

The ejected composite polymer streams were cooled and solidified, and an oil was then applied thereto. The resultant filaments were wound up at a spinning speed of 1,000 m/min and drawn between rollers respectively heated at 90° C. and 130° C., thereby producing an 84-dtex 36-filament (single-filament fineness, 2.3 dtex) drawn fiber. Thereafter, the drawn fiber was subjected to a PEG-removing treatment, thereby obtaining a glossy fiber having air voids therein (void diameter 36 nm; number density, 16.7 voids/$\mu m^2$).

The glossy fiber obtained had a ratio between the inscribed circle diameter $R_B$ and the circumscribed circle diameter $R_C$ of 1.8 and a ratio between the circumscribed circle diameter $R_C$ and the circumscribed circle diameter $R_D$ of the light absorption region of 0.83. A fabric produced from the glossy fiber had optical parameters including an average reflectance of 68%, an average transmittance of 10%, and a contrast gloss of 1.5 and had an appearance with an exceedingly deep, lustrous gloss. The fabric had an excellent feeling and heat storage properties. The results are shown in Table 1.

Example 2

An 84-dtex 36-filament glossy fiber was obtained in the same manner as in Example 1, except that the polymer 1 was replaced with poly(ethylene terephthalate) containing 1.0 wt % perylene black particles (average transmittance, 0.5%) (1.0 wt % PB-containing PET; melt viscosity, 120 Pa·s).

A fabric produced from the glossy fiber obtained had an appearance with a deep lustrous gloss due to the addition of perylene black. Since the fiber constituting the fabric has flexibility with a single-filament fineness of 2.3 dtex, the fabric had a soft touch. The fabric further was high in light reflection and the like, and had excellent heat-insulating properties as a function.

Example 3

An 84-dtex 36-filament glossy fiber was obtained in the same manner as in Example 1, except that poly(butylene terephthalate) containing 1.0 wt % perylene black particles (average transmittance, 0.5%) (1.0 wt % PB-containing PBT; melt viscosity, 140 Pa·s) as polymer 1, poly(butylene terephthalate) (PBT; melt viscosity, 140 Pa·s) as polymer 2, and poly(lactic acid) alloyed with 10 wt % poly(ethylene glycol) (10 wt % PEG-alloyed PLA; melt viscosity, 100 Pa·s) as polymer 3 were separately melted at 260° C.

A fabric produced form the glossy fiber obtained had an excellent reflectance due to a difference in refractive index between the PBT and the PLA and had excellent heat-insulating properties due to the control of light transmittance by the addition of perylene black. The results are shown in Table 1.

Example 4

An 84-dtex 36-filament glossy fiber was obtained in the same manner as in Example 1, except that polyamide-6 containing 0.5 wt % carbon black particles (average transmittance, 0.1%) (0.5 wt % CB-containing N6; melt viscosity, 100 Pa·s) as polymer 1, polyamide-6 (N6; melt viscosity, 100 Pa·s) as polymer 2, and polyamide-6 alloyed with 10 wt % poly(ethylene terephthalate) with which 5-sodium-sulfoisophthalic acid had been copolymerized (N6 alloyed with 10 wt % PET copolymerized with SSIA; melt viscosity, 120 Pa·s) as polymer 3 were separately melted at 280° C.

The fabric obtained had excellent softness and had a deep lustrous gloss while having the touch peculiar to polyamide-6. The results are shown in Table 1.

Comparative Example 1

Poly(ethylene terephthalate) containing 0.5 wt % carbon black particles (average transmittance, 0.1%) (0.5 wt % CB-containing PET; melt viscosity, 120 Pa·s) as polymer 1 and poly(ethylene terephthalate) (PET; melt viscosity, 120 Pa·s) as polymer 2 were separately melted at 290° C. and then introduced into a spinning pack including the complex spinneret shown in FIG. 10 in such a proportion that the polymer 1/polymer 2 ejection ratio was 5/95 in terms of areal ratio in the fiber cross-section. The introduced polymers were ejected from each ejection hole to result in a composite configuration which had a concentric composite cross-sectional shape of fiber such as that shown in FIG. 4(*a*).

The ejected composite polymer streams were cooled and solidified, and an oil was then applied thereto. The resultant filaments were wound up at a spinning speed of 1,000 m/min and drawn between rollers respectively heated at 90° C. and 130° C., thereby producing an 84-dtex 36-filament (single-filament fineness, 2.3 dtex) glossy fiber.

The fabric obtained had an appearance with a low gloss. This fabric had high light transmission and did not have a deep lustrous gloss. With respect to heat-insulating properties, this fabric showed low heat insulation performance because light passed through the sheaths. The results are shown in Table 1.

Example 5

An 84-dtex 36-filament glossy fiber was obtained in the same manner as in Example 1, except that the composite configuration (FIG. 1(*b*)) was modified so that the number of superposed layers was 2.

A fabric produced from the glossy fiber obtained had an appearance with a low average reflectance because the number of superposed layers, which served to reflect light, was small. However, the fabric sufficiently exhibited a deep lustrous gloss. The results are shown in Table 2.

Example 6

Poly(ethylene terephthalate) containing 0.5 wt % carbon black particles (average transmittance, 0.1%) (0.5 wt % CB-containing PET; melt viscosity, 120 Pa·s) as polymer 1 and poly(ethylene terephthalate) alloyed with 5 wt % poly (ethylene glycol) (5 wt % PEG-alloyed PET; melt viscosity, 80 Pa·s) as polymer 2 were separately melted at 290° C. and then introduced into a spinning pack including the complex spinneret shown in FIG. 10 in such a proportion that the polymer 1/polymer 2 ejection ratio was 10/90 in terms of areal ratio in the fiber cross-section. The introduced polymers were ejected from each ejection hole to result in a three-leafed composite cross-sectional shape of fiber such as that shown in FIG. 1(*a*). Through this ejection, the polymers were disposed so that a Y-shaped core made of polymer 1 was a light absorption region and a sheath made of polymer 2 was a light reflection region.

The ejected composite polymer streams were cooled and solidified, and an oil was then applied thereto. The resultant filaments were wound up at a spinning speed of 1,000 m/min and drawn between rollers respectively heated at 90° C. and 130° C., thereby producing an 84-dtex 36-filament (single-filament fineness, 2.3 dtex) drawn fiber. Thereafter, the drawn fiber was subjected to a PEG-removing treatment, thereby obtaining a glossy fiber.

The glossy fiber obtained had a slightly low glossy sense because the light reflection region had no superposed layers. However, the gloss was on a satisfactory level. The results are shown in Table 2.

Example 7

An 84-dtex 36-filament glossy fiber was obtained in the same manner as in Example 6, except that the polymer 2 was replaced with poly(ethylene terephthalate) (PET; melt viscosity, 120 Pa·s).

A fabric produced from the glossy fiber obtained had a characteristic appearance with a gloss which increased depending on angle, and had an excellent feeling. The results are shown in Table 2.

Example 8

Figure 3A:
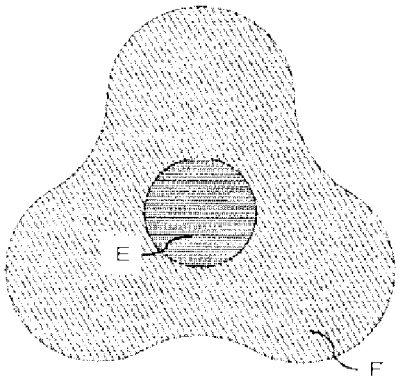
FIGS. 3(*a*) and 3(*b*) are diagrammatic views of the cross-sectional structure of a fiber.
Figure 3B:
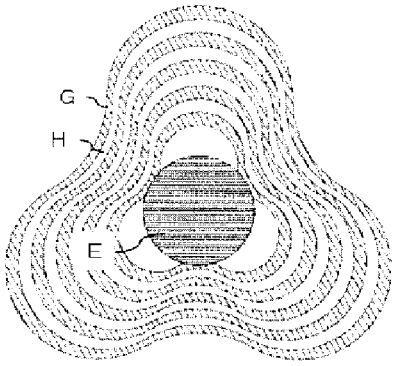

An 84-dtex 36-filament glossy fiber was obtained in the same manner as in Example 7, except that the molten polymers were introduced into a spinning pack including the complex spinneret shown in FIG. 10 and ejected to result in a composite configuration having a three-leafed composite cross-sectional shape of fiber shown in FIG. 3(*a*).

A fabric produced from the glossy fiber obtained had a characteristic appearance with a gloss which increased depending on angle, and had an excellent feeling. The results are shown in Table 2.

Comparative Example 2

Poly(ethylene terephthalate) (PET; melt viscosity, 120 Pa·s) was melted at 290° C. and then introduced into a spinning pack. The introduced polymer was ejected from each ejection hole to result in a three-leafed cross-sectional shape of fiber. The ejected polymer streams were cooled and solidified, and an oil was then applied thereto. The resultant filaments were wound up at a spinning speed of 1,000 m/min and drawn between rollers respectively heated at 90° C. and 130° C., thereby obtaining an 84-dtex 36-filament (single-filament fineness, 2.3 dtex) glossy fiber.

A fabric produced from the fiber had a high average reflectance and high light transmission and, hence, intense light reflection was sensed depending on angle. This fabric did not have a fascinating gloss. The results are shown in Table 2.

Example 9

An 84-dtex 36-filament glossy fiber was obtained in the same manner as in Example 1, except that the molten polymers were introduced into the spinning pack including the complex spinneret shown in FIG. 10 in which the shape of each ejection hole had been regulated to give a three-leafed cross-sectional shape of fiber having a higher degree of non-circularity than in Example 1.

A fabric produced from the glossy fiber obtained had an appearance with a fascinating gloss which increased depending on angle. The results are shown in Table 3.

Comparative Example 3

An 84-dtex 36-filament glossy fiber was obtained in the same manner as in Example 1, except that the molten polymers were introduced into the spinning pack including the complex spinneret shown in FIG. 10 in which the shape of each ejection hole had been regulated to give a three-leafed cross-sectional shape of fiber having a higher degree of non-circularity than in Example 9.

A fabric produced from this fiber had an appearance with a glaring sense due to the heightened contrast gloss, and the glaringness was enhanced by the reduced average transmittance. The results are shown in Table 3.

Example 10

Figure 2A:
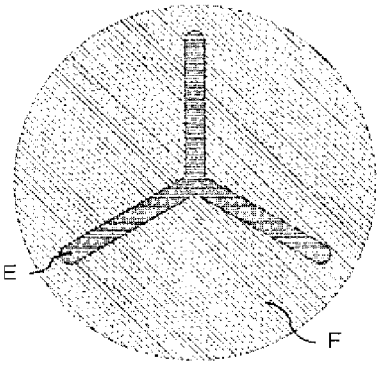
FIGS. 2(*a*) and 2(*b*) are diagrammatic views of the cross-sectional structure of a fiber.

An 84-dtex 36-filament glossy fiber was obtained in the same manner as in Example 1, except that a composite cross-sectional shape of the fiber was a round shape as shown in FIG. 2(*b*) and the number of superposed layers was 10.

A fabric produced from the glossy fiber obtained had an appearance with a deep lustrous gloss. The fabric, configured of round cross-sections, had a smooth surface and an elegant touch due to the small value of single-filament fineness. This fabric had an excellent feeling. The results are shown in Table 3.

Example 11

An 84-dtex 36-filament glossy fiber was obtained in the same manner as in Example 1, except that a composite cross-sectional shape of the fiber was a round shape as shown in FIG. 4(*b*) and the number of superposed layers was 10.

A fabric produced from the glossy fiber obtained had a heightened average transmittance, but had a deep lustrous gloss. This fabric had a smooth touch due to the round cross-section. The results are shown in Table 3.

Comparative Example 4

An 84-dtex 36-filament glossy fiber was obtained in the same manner as in Example 11, except that the polymers were ejected in such a proportion that the polymer 1/polymer 2/polymer 3 ejection ratio was 5/47.5/47.5 in terms of areal ratio in the fiber cross-section.

A fabric produced from the fiber of Comparative Example 4 had an appearance with a heightened average transmittance due to the reduced proportion of polymer 1. This fabric had a gloss which was intense, but poor in deepness. The results are shown in Table 3.

Example 12

An 84-dtex 36-filament glossy fiber was obtained in the same manner as in Example 1, except that the polymer 1 was replaced with poly(ethylene terephthalate) containing 5.0 wt % carbon black particles (average transmittance, 0.1%) (5.0 wt % CB-containing PET; melt viscosity, 120 Pa·s).

A fabric produced from the glossy fiber obtained had an appearance with a deep fascinating gloss. The results are shown in Table 4.

Example 13

An 84-dtex 36-filament glossy fiber was obtained in the same manner as in Example 1, except that the polymer 3 was replaced with poly(ethylene terephthalate) alloyed with 1.0 wt % poly(ethylene glycol) (1.0 wt % PEG-alloyed PET; melt viscosity, 100 Pa·s).

A fabric produced from the glossy fiber obtained had an appearance with a characteristic gloss which increased depending on angle. The results are shown in Table 4.

Example 14

An 84-dtex 24-filament (single-filament fineness, 3.5 dtex) glossy fiber was obtained in the same manner as in Example 1, except that the number of filaments was changed to 24.

A fabric produced from the glossy fiber obtained had an appearance with a deep lustrous gloss. This fabric had a satisfactory feeling. The results are shown in Table 4.

Example 15

An 84-dtex 12-filament (single-filament fineness, 7.0 dtex) glossy fiber was obtained in the same manner as in Example 1, except that the number of filaments was changed to 12.

A fabric produced from the glossy fiber obtained had an appearance with a gloss which increased depending on angle. Due to the increased value of single-filament fineness, the fabric had an enhanced sense of ruggedness and the appearance thereof had a shadowy sense. Although the increased value of single-filament fineness resulted in an increase in the rigidity of the fabric, this was not problematic for use in garment applications. The results are shown in Table 4.

Comparative Example 5

An 84-dtex 36-filament fiber was obtained in the same manner as in Example 1, except that the polymer 1 was replaced with poly(ethylene terephthalate) containing 20 wt % carbon black particles (average transmittance, 0.1%) (20 wt % CB-containing PET; melt viscosity, 120 Pa·s).

A fabric produced from the fiber obtained had a black appearance with little gloss. This fabric was poor in gloss. The results are shown in Table 5.

Comparative Example 6

An 84-dtex 36-filament fiber was obtained in the same manner as in Example 7, except that the polymer 1 was replaced with poly(ethylene terephthalate) containing 20 wt % carbon black particles (average transmittance, 0.1%) (20 wt % CB-containing PET; melt viscosity, 120 Pa·s).

A fabric produced from the fiber obtained had a black appearance with little gloss. This fabric was poor in gloss. The results are shown in Table 5.

Comparative Example 7

An 84-dtex 36-filament fiber was obtained in the same manner as in Example 8, except that the polymer 1 was replaced with poly(ethylene terephthalate) containing 20 wt % carbon black particles (average transmittance, 0.1%) (20 wt % CB-containing PET; melt viscosity, 120 Pa·s).

A fabric produced from the fiber obtained had a black appearance with little gloss. This fabric was poor in gloss. The results are shown in Table 5.

Comparative Example 8

An 84-dtex 36-filament fiber was obtained in the same manner as in Comparative Example 7, except that the polymer 1 was replaced with poly(ethylene terephthalate) containing 20 wt % carbon black particles (average transmittance, 0.1%) (20 wt % CB-containing PET; melt viscosity, 120 Pa·s) and that the polymers were ejected to yield a fiber having a round cross-section.

A fabric produced from the fiber obtained had a black appearance with little gloss. This fabric was poor in gloss. The results are shown in Table 5.

Comparative Example 9

An 84-dtex 36-filament fiber was obtained in the same manner as in Example 1, except that the polymer 1 was replaced with poly(ethylene terephthalate) containing 1.0 wt % silica particles (average transmittance, 62.2%) (1.0 wt % $SiO_2$-containing PET; melt viscosity, 120 Pa·s).

A fabric produced from the fiber obtained had an appearance with a gloss which, although intense, was not a deep lustrous one. The results are shown in Table 5.

Example 16

Poly(ethylene terephthalate) (PET; melt viscosity, 120 Pa·s; refractive index, 1.66) as compositing ingredient 1, poly(ethylene terephthalate) with which a spiroglycol and cyclohexanedicarboxylic acid had been copolymerized (PET copolymerized with SPG and CHDC; melt viscosity, 120 Pa·s; refractive index, 1.53) as compositing ingredient 2, and poly(ethylene terephthalate) containing 0.5 wt % carbon black (CB) (0.5 wt % CB-containing PET; melt viscosity, 120 Pa·s; refractive index 1.66) as compositing ingredient 3 were separately melted at 285° C. and then introduced into a spinning pack including the complex spinneret shown in FIG. 10, in such a proportion that the multilayer ingredient 1/multilayer ingredient 2/non-multilayer ingredient ejection ratio was 40/40/20 in terms of areal ratio in the cross-section of composite fiber. The introduced polymers were ejected from each ejection hole to result in a composite configuration which had a composite fiber cross-section such as that shown in FIG. 5 and in which the number of superposed layers was 20. Through this ejection, the ingredients were disposed so that the non-multilayer ingredient formed a cross-shaped non-multilayer region and a multilayer region was an alternating multilayer structure including multilayer ingredient 1/multilayer ingredient 2/multilayer ingredient 1/ • • • , with the outermost layer being multilayer ingredient 1. The ejected composite polymer streams were cooled and solidified, and an oil was then applied thereto. The resultant filaments were wound up at a spinning speed of 1,300 m/min to obtain a 180-dtex 24-filament (total ejection rate, 23 g/min) undrawn fiber. The undrawn fiber wound up was drawn 3.2 times between rollers respectively heated at 90° C. and 130° C. to obtain a 56-dtex 24-filament (single-filament fineness, 2.3 dtex) glossy fiber. The multilayer region of the glossy fiber obtained had a single-layer thickness of 0.30 μm for each ingredient, and the number of portions into which the multilayer region had been divided by the non-multilayer region was 4. The glossy fiber had an appearance having an exceedingly lustrous gloss and an intense reddish purple color. A fabric produced from the glossy fiber had an excellent feeling. The results are shown in Table 6.

Example 17

A 56-dtex 24-filament (single-filament fineness, 2.3 dtex) glossy fiber was obtained in the same manner as in Example 16, except that the molten polymers were ejected to result in a composite configuration in which the number of superposed layers was 10. The glossy fiber obtained had an appearance having a lustrous gloss and a red color because of the changed layer thickness. The results are shown in Table 6.

Example 18

A 56-dtex 24-filament (single-filament fineness, 2.3 dtex) glossy fiber was obtained in the same manner as in Example 16, except that the molten polymers were ejected to result in a composite configuration in which the number of superposed layers was 4. The glossy fiber obtained had an appearance having a slightly lustrous gloss and a pale red color because of the changed layer thickness. The results are shown in Table 6.

Example 19

A 56-dtex 24-filament (single-filament fineness, 2.3 dtex) glossy fiber was obtained in the same manner as in Example 16, except that the compositing ingredient 3 was replaced with poly(ethylene terephthalate) with which 5-sodium-sulfoisophthalic acid had been copolymerized (PET copolymerized with SSIA; melt viscosity, 120 Pa·s; refractive index, 1.63). The glossy fiber obtained was dyed with a black cationic dye. The dyed fiber had an appearance having an exceedingly lustrous gloss and an intense reddish purple color. The results are shown in Table 6.

Example 20

A 56-dtex 24-filament (single-filament fineness, 2.3 dtex) glossy fiber was obtained in the same manner as in Example 16, except that the molten polymers were ejected to result in a fiber cross-section configured of a multilayer region having concentrically superposed circular layers and a non-multilayer region as a central circle such as that shown in FIG. 7(*a*). The glossy fiber obtained had an exceedingly lustrous gloss and had an intense reddish orange color because of the changed layer thickness. The results are shown in Table 6.

Example 21

A 56-dtex 24-filament (single-filament fineness, 2.3 dtex) glossy fiber was obtained in the same manner as in Example 16, except that the molten polymers were ejected to result in a fiber cross-section configured of a multilayer region having concentrically superposed circular layers and a bar-shaped non-multilayer region such as that shown in FIG. 7(*b*). The glossy fiber obtained had an exceedingly lustrous gloss, which changed with viewing angle, and had an intense reddish orange color because of the changed layer thickness. The results are shown in Table 6.

Example 22

Figure 6:
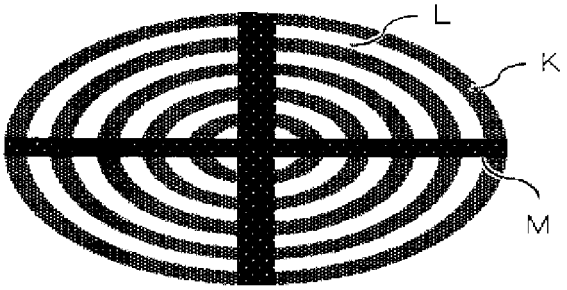
FIG. 6 is a diagrammatic view of the cross-sectional structure of a glossy fiber.

A 56-dtex 24-filament (single-filament fineness, 2.3 dtex) glossy fiber was obtained in the same manner as in Example 16, except that the molten polymers were ejected to result in a fiber cross-section including a multilayer region having concentrically superposed elliptic layers such as that shown in FIG. 6. The glossy fiber obtained had an exceedingly lustrous gloss and had an intense reddish purple color. A fabric produced from the glossy fiber had a satisfactory feeling, although slightly stiff because of the compressed cross-section of the fiber. The results are shown in Table 6.

Comparative Example 10

Figure 8:
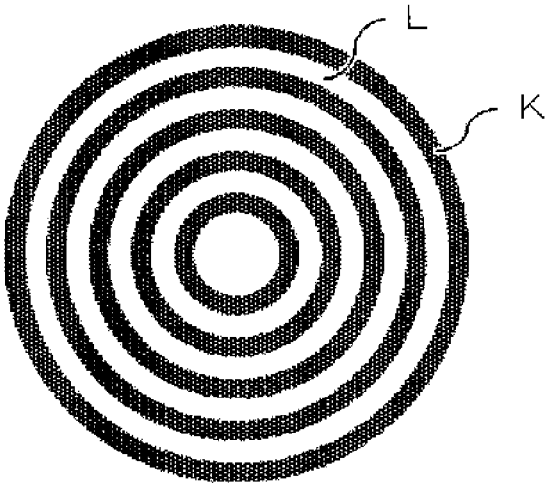
FIG. 8 is a diagrammatic view of the cross-sectional structure of a conventional fiber including alternately-superposed concentric layers.

Poly(ethylene terephthalate) (PET; melt viscosity, 120 Pa·s; refractive index, 1.66) as multilayer ingredient 1 and poly(ethylene terephthalate) with which a spiroglycol and cyclohexanedicarboxylic acid had been copolymerized (PET copolymerized with SPG and CHDC; melt viscosity, 120 Pa·s; refractive index, 1.53) as multilayer ingredient 2 were separately melted at 285° C. and then introduced into a spinning pack including the complex spinneret shown in FIG. 10, in such a proportion that the multilayer ingredient 1/multilayer ingredient 2 ejection ratio was 50/50 in terms of areal ratio in the cross-section of composite fiber. The introduced polymers were ejected from each ejection hole to result in a composite configuration which had a fiber cross-section having concentrically and evenly superposed layers such as that shown in FIG. 8, and in which the number of superposed layers was 24. Through this ejection, the ingredients were disposed to form an alternating multilayer structure including multilayer ingredient 1/multilayer ingredient 2/multilayer ingredient 1/ • • • , with the outermost layer being multilayer ingredient 1. The ejected composite polymer streams were cooled and solidified, and an oil then applied thereto. The resultant filaments were wound up at a spinning speed of 1,300 m/min to obtain a 180-dtex 24-filament (total ejection rate, 23 g/min) undrawn fiber. The undrawn fiber wound up was drawn 3.2 times between rollers respectively heated at 90° C. and 130° C. to obtain a 56-dtex 24-filament (single-filament fineness, 2.3 dtex) drawn fiber. However, the drawn fiber had an appearance with no lustrous gloss. The results are shown in Table 6.

Comparative Example 11

Figure 9:
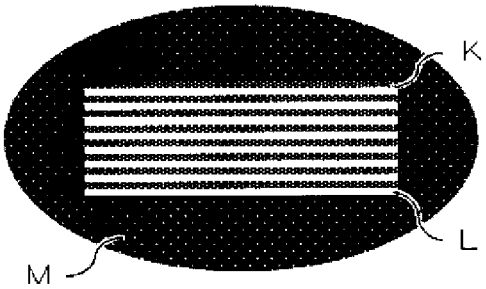
FIG. 9 is a diagrammatic view of the cross-sectional structure of a conventional fiber including alternately-superposed flat layers.

Poly(ethylene terephthalate) with which 5-sodium-sulfoisophthalic acid had been copolymerized (PET copolymerized with SSIA; melt viscosity, 120 Pa·s; refractive index, 1.63) as multilayer ingredient 1, polyamide-6 (N6; melt viscosity, 100 Pa·s; refractive index, 1.53) as multilayer ingredient 2, and poly(ethylene terephthalate) with which 5-sodiumsulfoisophthalic acid had been copolymerized (PET copolymerized with SSIA; melt viscosity, 120 Pa·s; refractive index, 1.63) as a non-multilayer ingredient were separately melted at 285° C. and then introduced into a spinning pack including the complex spinneret shown in FIG. 10, in such a proportion that the multilayer ingredient 1/multilayer ingredient 2/non-multilayer ingredient ejection ratio was 20/20/60 in terms of areal ratio in the cross-section of composite fiber. The introduced polymers were ejected from each ejection hole to result in a composite configuration which had a composite fiber cross-section such as that shown in FIG. 9 and in which the number of superposed layers was 40. Through this ejection, the ingredients were disposed to form a non-multilayer region as an outermost protective layer and a multilayer region which was an alternating platy multilayer structure including multilayer ingredient 1/multilayer ingredient 2/multilayer ingredient 1/ • • • , with the outermost layer being multilayer ingredient 1. The ejected composite polymer streams were cooled and solidified, and an oil then applied thereto. The resultant filaments were wound up at a spinning speed of 1,300 m/min to obtain a 384-dtex 24-filament (total ejection rate, 50 g/min) undrawn fiber having a compressed shape. The undrawn fiber wound up was drawn 3.2 times between rollers respectively heated at 90° C. and 130° C. to obtain a 120-dtex 24-filament (single-filament fineness, 5.0 dtex) glossy fiber. However, the glossy fiber had an appearance with no lustrous gloss. A fabric produced from the drawn fiber had a stiff touch and was poor in feeling. The results are shown in Table 6.

Example 23

An 84-dtex 24-filament (single-filament fineness, 3.5 dtex) drawn fiber was obtained in the same manner as in Example 16, except that the undrawn fiber was produced as a 270-dtex 24-filament (total ejection rate, 35 g/min) undrawn fiber. The glossy fiber obtained had an appearance which had an exceedingly lustrous gloss and had an intense blue color because of the changed layer thickness. A fabric produced from the glossy fiber had a satisfactory feeling, although slightly stiff because of the larger value of single-filament fineness. The results are shown in Table 7.

Example 24

A 56-dtex 24-filament (single-filament fineness, 2.3 dtex) glossy fiber was obtained in the same manner as in Example 16, except that the molten ingredients were ejected in an ejection ratio of 25/25/50 in terms of areal ratio in the cross-section of composite fiber. The glossy fiber obtained had an appearance having a slightly blackish lustrous gloss and an intense bluish green color because of the changed layer thickness. The results are shown in Table 7.

Example 25

A 56-dtex 24-filament (single-filament fineness, 2.3 dtex) glossy fiber was obtained in the same manner as in Example 16, except that the molten ingredients were ejected in an ejection ratio of 15/15/70 in terms of areal ratio in the cross-section of composite fiber. The glossy fiber obtained had an appearance having a blackish, slightly lustrous gloss and an intense purple color because of the changed layer thickness. The results are shown in Table 7.

Example 26

A 56-dtex 24-filament (single-filament fineness, 2.3 dtex) glossy fiber was obtained in the same manner as in Example 16, except that the multilayer ingredient 2 was replaced with poly(ethylene terephthalate) with which 30 mol % 1,4-cyclohexanedimethanol had been copolymerized (PET copolymerized with CHDM; melt viscosity, 100 Pa·s, refractive index, 1.58). The glossy fiber obtained had a lustrous gloss and a reddish purple color. The results are shown in Table 7.

Example 27

A 56-dtex 24-filament (single-filament fineness, 2.3 dtex) glossy fiber was obtained in the same manner as in Example 16, except that poly(ethylene terephthalate) (PET; melt viscosity, 120 Pa·s; refractive index, 1.66) as multilayer ingredient 1, poly(butylene terephthalate) (PBT; melt viscosity, 120 Pa·s; refractive index, 1.65) as multilayer ingredient 2, and poly(ethylene terephthalate) containing 0.5 wt % carbon black (CB) (0.5 wt % CB-containing PET; melt viscosity, 120 Pa·s; refractive index, 1.66) as a non-multilayer ingredient were separately melted at 280° C. The glossy fiber obtained had a slightly lustrous gloss and a pale reddish purple color. The results are shown in Table 7.

Example 28

Poly(butylene terephthalate) (PBT; melt viscosity, 120 Pa·s; refractive index, 1.65) as multilayer ingredient 1, poly(lactic acid) (PLA; melt viscosity, 120 Pa·s; refractive index, 1.45) as multilayer ingredient 2, and poly(butylene terephthalate) containing 0.5 wt % carbon black (CB) (0.5 wt % CB-containing PBT; melt viscosity, 120 Pa·s; refractive index 1.65) as a non-multilayer ingredient were separately melted at 260° C. and then introduced into a spinning pack including the complex spinneret shown in FIG. 10, in such a proportion that the multilayer ingredient 1/multilayer ingredient 2/non-multilayer ingredient ejection ratio was 40/40/20 in terms of areal ratio in the cross-section of composite fiber. The introduced polymers were ejected from each ejection hole to result in a composite configuration which had a composite fiber cross-section such as that shown in FIG. 5 and in which the number of superposed layers was 20. Through this ejection, the ingredients were disposed to form a cross-shaped non-multilayer region and a multilayer region which was an alternating multilayer structure including multilayer ingredient 1/multilayer ingredient 2/multilayer ingredient 1/ • • • , with the outermost layer being multilayer ingredient 1. The ejected composite polymer streams were cooled and solidified, and an oil was then applied thereto. The resultant filaments were wound up at a spinning speed of 3,000 m/min to obtain a 90-dtex 24-filament (total ejection rate, 27 g/min) undrawn fiber. The undrawn fiber wound up was drawn 1.6 times between rollers respectively heated at 90° C. and 130° C. to obtain a 56-dtex 24-filament (single-filament fineness, 2.3 dtex)

glossy fiber. The glossy fiber obtained had an exceedingly lustrous gloss and an intense blue color. The results are shown in Table 7.

Example 29

A 56-dtex 24-filament (single-filament fineness, 2.3 dtex) glossy fiber was obtained in the same manner as in Example 16, except that polyamide-6 (N6; melt viscosity, 100 Pa·s; refractive index, 1.53) as multilayer ingredient 1, poly (ethylene terephthalate) with which 5-sodiumsulfoisophthalic acid had been copolymerized (PET copolymerized with SSIA; melt viscosity, 120 Pa·s; refractive index, 1.63) as multilayer ingredient 2, and polyamide-6 containing 0.5 wt % carbon black (CB) (0.5 wt % CB-containing N6; melt viscosity, 100 Pa·s; refractive index, 1.53) as a non-multilayer ingredient were separately melted at 280° C. The glossy fiber obtained had an exceedingly lustrous gloss and an intense reddish purple color. The results are shown in Table 7.

Comparative Example 12

A 56-dtex 24-filament (single-filament fineness, 2.3 dtex) drawn fiber was obtained in the same manner as in Example 16, except that the multilayer ingredients 1 and 2 were both replaced with poly(ethylene terephthalate) (PET; melt viscosity, 120 Pa·s; refractive index, 1.66). The drawn fiber obtained had no multilayer structure and had an appearance with no lustrous gloss. The results are shown in Table 7.

TABLE 1

Figure 1B:
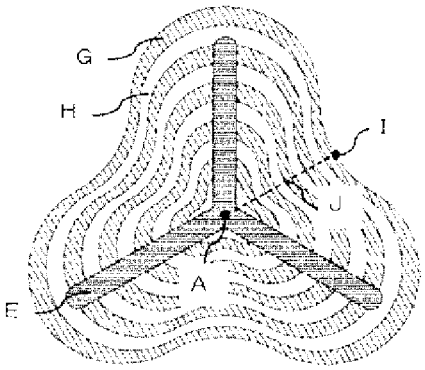
Figure 4A:
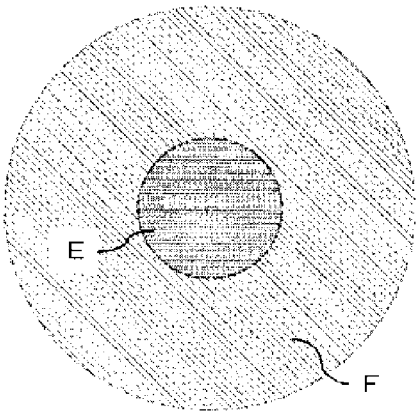
FIGS. 4(*a*) and 4(*b*) are diagrammatic views of the cross-sectional structure of a fiber.

| | | Example 1 | Example 2 | Example 3 | Example 4 | Comparative Example 1 |
|---|---|---|---|---|---|---|
| Polymers | Polymer 1 | 0.5 wt % CB-containing PET | 0.5 wt % PB-containing PET | 1.0 wt % PB-containing PBT | 0.5 wt % CB-containing N6 | 0.5 wt % CB-containing PET |
| | Polymer 2 | PET | PET | PBT | N6 | PET |
| | Polymer 3 | 10 wt % PEG-alloyed PET | 10 wt % PEG-alloyed PET | 10 wt % PEG-alloyed PLA | N6 alloyed with 10 wt % PET copolymerized with SSIA | — |
| Additive particles | Amount of addition to polymer 1 (wt %) | 0.50 | 0.50 | 0.50 | 0.50 | 0.50 |
| | Average transmittance of the particles (%) | 0.1 | 1.0 | 0.1 | 0.1 | 0.1 |
| Fineness | Total fineness (dtex) | 84.0 | 84.0 | 84.0 | 84.0 | 84.0 |
| | Single-filament fineness (dtex) | 2.3 | 2.3 | 2.3 | 2.3 | 2.3 |
| Fiber cross-section | Cross-sectional shape | three-leafed | three-leafed | three-leafed | three-leafed | round |
| | Composite structure (light absorption region/ light reflection region) | Y-core/concentric alternating multilayer (FIG. 1(b)) | Y-core/concentric alternating multilayer (FIG. 1(b)) | Y-core/concentric alternating multilayer (FIG. 1(b)) | Y-core/concentric alternating multilayer (FIG. 1(b)) | round core/sheath (FIG. 4(a)) |
| | Areal ratio (polymers 1/2/3) | 10/45/45 | 10/45/45 | 10/45/45 | 10/45/45 | 5/95/— |
| | $R_C/R_B$ | 1.8 | 1.8 | 1.9 | 1.7 | 1.8 |
| | $R_D/R_C$ | 0.83 | 0.83 | 0.82 | 0.83 | 0.23 |
| | Number of superposed layers | 10 | 10 | 10 | 10 | — |
| Air voids | Number density (voids/μm$^2$) | 16.7 | 16.1 | 14.6 | 8.2 | — |
| | Void diameter (nm) | 36 | 38 | 45 | 61 | — |
| Optical parameters | Average reflectance (%) | 68 | 71 | 77 | 63 | 39 |
| | Average transmittance (%) | 10 | 17 | 14 | 16 | 42 |
| | Contrast gloss | 1.5 | 1.4 | 1.5 | 1.4 | 2.3 |
| Glossy sense | | excellent | excellent | excellent | excellent | poor |
| Feeling (touch and softness) | | excellent | excellent | excellent | excellent | excellent |
| Heat-insulating property ΔT (° C.) | | 2.3 | 1.4 | 0.8 | 3.4 | 5.3 |

PET, poly(ethylene terephthalate);
PEG, poly(ethylene glycol);
CB, carbon black;
PB, perylene black;
PBT, poly(butylene terephthalate);
PLA, poly(lactic acid);
N6, polyamide-6;
SSIA, 5-sodiumsulfoisophthalic acid

TABLE 2

| | | Example 5 | Example 6 | Example 7 | Example 8 | Comparative Example 2 |
|---|---|---|---|---|---|---|
| Polymers | Polymer 1 | 0.5 wt % CB-containing PET | 0.5 wt % CB-containing PET | 0.5 wt % CB-containing PET | 0.5 wt % CB-containing PET | PET |
| | Polymer 2 | PET | 5 wt % PEG-alloyed PET | PET | PET | — |
| | Polymer 3 | 10 wt % PEG-alloyed PET | — | — | — | — |

TABLE 2-continued

| | | Example 5 | Example 6 | Example 7 | Example 8 | Comparative Example 2 |
|---|---|---|---|---|---|---|
| Additive particles | Amount of addition to polymer 1 (wt %) | 0.50 | 0.50 | 0.50 | 0.50 | — |
| | Average transmittance of the particles (%) | 0.1 | 0.1 | 0.1 | 0.1 | — |
| Fineness | Total fineness (dtex) | 84.0 | 84.0 | 84.0 | 84.0 | 84.0 |
| | Single-filament fineness (dtex) | 2.3 | 2.3 | 2.3 | 2.3 | 2.3 |
| Fiber cross-section | Cross-sectional shape | three-leafed | three-leafed | three-leafed | three-leafed | three-leafed |
| | Composite structure (light absorption region/light reflection region) | Y-core/concentric alternating multilayer (FIG. 1(b)) | Y-core/sheath (FIG. 1(a)) | Y-core/sheath (FIG. 1(a)) | round core/sheath (FIG. 3(a)) | — |
| | Areal ratio (polymers 1/2/3) | 10/45/45 | 10/90/— | 10/90/— | 10/90/— | — |
| | $R_C/R_B$ | 1.8 | 1.8 | 1.8 | 1.8 | 1.8 |
| | $R_D/R_C$ | 0.83 | 0.83 | 0.83 | 0.34 | — |
| | Number of superposed layers | 2 | — | — | — | — |
| Air voids | Number density (voids/μm$^2$) | 16.3 | 16.9 | — | — | — |
| | Void diameter (nm) | 32 | 42 | — | — | — |
| Optical parameters | Average reflectance (%) | 55 | 45 | 33 | 38 | 55 |
| | Average transmittance (%) | 16 | 17 | 28 | 35 | 58 |
| | Contrast gloss | 1.5 | 1.5 | 2.1 | 2.4 | 2.2 |
| Glossy sense | | good | good | good | good | poor |
| Feeling (touch and softness) | | excellent | excellent | excellent | excellent | excellent |

PET, poly(ethylene terephthalate);
PEG, poly(ethylene glycol);
CB, carbon black

TABLE 3

Figure 2B:
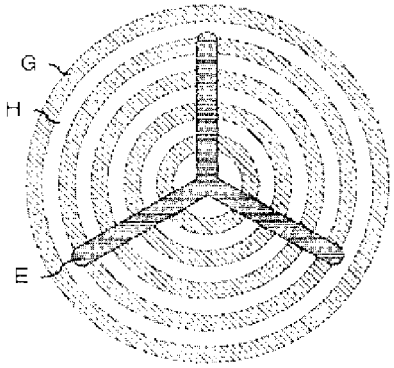
Figure 4B:
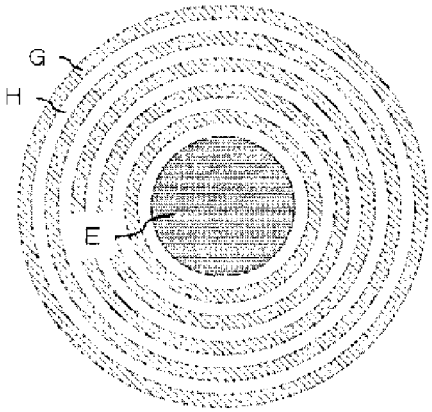

| | | Example 9 | Comparative Example 3 | Example 10 | Example 11 | Comparative Example 4 |
|---|---|---|---|---|---|---|
| Polymers | Polymer 1 | 0.5 wt % CB-containing PET | 0.5 wt % CB-containing PET | 0.5 wt % CB-containing PET | 0.5 wt % CB-containing PET | 0.5 wt % CB-containing PET |
| | Polymer 2 | PET | PET | PET | PET | PET |
| | Polymer 3 | 10 wt % PEG-alloyed PET | 10 wt % PEG-alloyed PET | 10 wt % PEG-alloyed PET | 10 wt % PEG-alloyed PET | 10 wt % PEG-alloyed PET |
| Additive particles | Amount of addition to polymer 1 (wt %) | 0.50 | 0.50 | 0.50 | 0.50 | 0.50 |
| | Average transmittance of the particles (%) | 0.1 | 0.1 | 0.1 | 0.1 | 0.1 |
| Fineness | Total fineness (dtex) | 84.0 | 84.0 | 84.0 | 84.0 | 84.0 |
| | Single-filament fineness (dtex) | 2.3 | 2.3 | 2.3 | 2.3 | 2.3 |
| Fiber cross-section | Cross-sectional shape | three-leafed | three-leafed | round | round | round |
| | Composite structure (light absorption region/ light reflection region) | Y-core/concentric alternating multilayer (FIG. 1(b)) | Y-core/concentric alternating multilayer (FIG. 1(b)) | Y-core/concentric alternating multilayer (FIG. 2(b)) | round core/ concentric alternating multilayer (FIG. 4(b)) | round core/ concentric alternating multilayer (FIG. 4(b)) |
| | Areal ratio (polymers 1/2/3) | 10/45/45 | 10/45/45 | 10/45/45 | 10/45/45 | 5/47.5/47.5 |
| | $R_C/R_B$ | 2.7 | 4.2 | 1.0 | 1.0 | 1.0 |
| | $R_D/R_C$ | 0.78 | 0.72 | 0.85 | 0.34 | 0.22 |
| | Number of superposed layers | 10 | 10 | 10 | 10 | 10 |
| Air voids | Number density (voids/μm$^2$) | 15.9 | 16.2 | 16.4 | 16.3 | 16.9 |
| | Void diameter (nm) | 31 | 33 | 42 | 39 | 34 |
| Optical parameters | Average reflectance (%) | 69 | 68 | 62 | 66 | 73 |
| | Average transmittance (%) | 11 | 13 | 12 | 27 | 41 |
| | Contrast gloss | 2.3 | 3.5 | 1.8 | 1.9 | 1.9 |
| Glossy sense | | good | poor | excellent | good | poor |
| Feeling (touch and softness) | | good | Fair | excellent | excellent | excellent |

PET, poly(ethylene terephthalate);
PEG, poly(ethylene glycol);
CB, carbon black

TABLE 4

| | | Example 12 | Example 13 | Example 14 | Example 15 |
|---|---|---|---|---|---|
| Polymers | Polymer 1 | 5.0 wt % CB-containing PET | 0.5 wt % CB-containing PET | 0.5 wt % CB-containing PET | 0.5 wt % CB-containing PET |
| | Polymer 2 | PET | PET | PBT | PET |
| | Polymer 3 | 10 wt % PEG-alloyed PET | 1.0 wt % PEG-alloyed PET | 10 wt % PEG-alloyed PET | 10 wt % PEG-alloyed PET |
| Additive particles | Amount of addition to polymer 1 (wt %) | 5.00 | 0.50 | 0.50 | 0.50 |
| | Average transmittance of the particles (%) | 0.1 | 0.1 | 0.1 | 0.1 |
| Fineness | Total fineness (dtex) | 84.0 | 84.0 | 84.0 | 84.0 |
| | Single-filament fineness (dtex) | 2.3 | 2.3 | 3.5 | 7.0 |
| Fiber cross-section | Cross-sectional shape | three-leafed | three-leafed | three-leafed | three-leafed |
| | Composite structure (light absorption region/light reflection region) | Y-core/concentric alternating multilayer (FIG. 1(b)) | Y-core/concentric alternating multilayer (FIG. 1(b)) | Y-core/concentric alternating multilayer (FIG. 1(b)) | Y-core/concentric alternating multilayer (FIG. 1(b)) |
| | Areal ratio (polymers 1/2/3) | 10/45/45 | 10/45/45 | 10/45/45 | 10/45/45 |
| | $R_C/R_B$ | 1.8 | 1.8 | 1.8 | 1.8 |
| | $R_D/R_C$ | 0.83 | 0.83 | 0.83 | 0.83 |
| | Number of superposed layers | 10 | 10 | 10 | 10 |
| Air voids | Number density (voids/μm$^2$) | 16.5 | 1.8 | 16.9 | 16.7 |
| | Void diameter (nm) | 38 | 42 | 30 | 32 |
| Optical parameters | Average reflectance (%) | 28 | 47 | 62 | 53 |
| | Average transmittance (%) | 5 | 19 | 13 | 12 |
| | Contrast gloss | 1.4 | 2.0 | 1.9 | 2.2 |
| | Glossy sense | good | good | excellent | good |
| | Feeling (touch and softness) | excellent | excellent | good | fair |

PET, poly(ethylene terephthalate);
PEG , poly(ethylene glycol);
CB, carbon black

TABLE 5

| | | Comparative Example 5 | Comparative Example 6 | Comparative Example 7 | Comparative Example 8 | Comparative Example 9 |
|---|---|---|---|---|---|---|
| Polymers | Polymer 1 | 20 wt % CB-containing PET | 20 wt % CB-containing PET | 20 wt % CB-containing PET | 20 wt % CB-containing PET | 1.0 wt % $SiO_2$-containing PET |
| | Polymer 2 | PET | PET | PET | PET | PET |
| | Polymer 3 | 10 wt % PEG-alloyed PET | — | — | — | 10 wt % PEG-alloyed PET |
| Additive particles | Amount of addition to polymer 1 (wt %) | 20.00 | 20.00 | 20.00 | 20.00 | 1.00 |
| | Average transmittance of the particles (%) | 0.1 | 0.1 | 0.1 | 0.1 | 62.2 |
| Fineness | Total fineness (dtex) | 84.0 | 84.0 | 84.0 | 84.0 | 84.0 |
| | Single-filament fineness (dtex) | 2.3 | 2.3 | 2.3 | 2.3 | 2.3 |
| Fiber cross-section | Cross-sectional shape | three-leafed | three-leafed | three-leafed | round | three-leafed |
| | Composite structure (light absorption region/ light reflection region) | Y-core/concentric alternating multilayer (FIG. 1(b)) | Y-core/sheath (FIG. 1(a)) | round core/sheath (FIG. 3(a)) | round core/sheath (FIG. 4(a)) | Y-core/concentric alternating multilayer (FIG. 1(b)) |
| | Areal ratio (polymers 1/2/3) | 10/45/45 | 10/90/— | 10/90/— | 10/90/— | 10/45/45 |
| | $R_C/R_B$ | 1.8 | 1.8 | 1.8 | 1.8 | 1.8 |
| | $R_D/R_C$ | 0.83 | 0.83 | 0.34 | 0.33 | 0.83 |
| | Number of superposed layers | 10 | — | — | — | 10 |
| Air voids | Number density (voids/μm$^2$) | 16.6 | — | — | — | 16.7 |
| | Void diameter (nm) | 42 | — | — | — | 36 |
| Optical parameters | Average reflectance (%) | 12 | 5 | 7 | 4 | 79 |
| | Average transmittance (%) | 1 | 1 | 3 | 3 | 42 |
| | Contrast gloss | 1.5 | 2.0 | 2.3 | 2.3 | 1.5 |
| Glossy sense | | poor | poor | poor | poor | poor |
| Feeling (touch and softness) | | excellent | excellent | excellent | excellent | excellent |

PET, poly(ethylene terephthalate);
PEG, poly(ethylene glycol);
CB, carbon black,
$SiO_2$, silica

TABLE 6

Figure 7A:
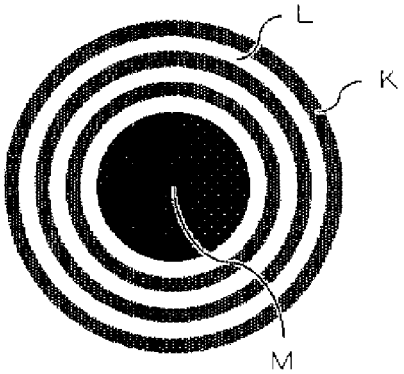
FIGS. 7(*a*) and 7(*b*) are diagrammatic views of the cross-sectional structures of glossy fibers.
Figure 7B:
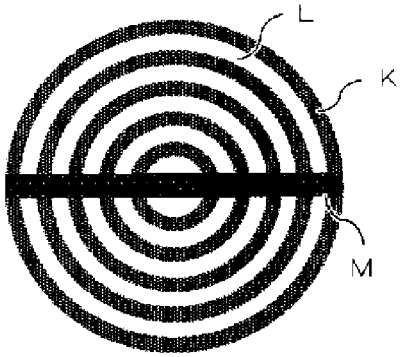

| | | Example 16 | Example 17 | Example 18 | Example 19 | Example 20 |
|---|---|---|---|---|---|---|
| Single-filament fineness (dtex) | | 2.3 | 2.3 | 2.3 | 2.3 | 2.3 |
| Composite shape | Cross-sectional shape, Multilayer region/non-multilayer region (reference Fig.) | concentric circular multilayer/ cross-shaped region (FIG. 5) | concentric circular multilayer/ cross-shaped region (FIG. 5) | concentric circular multilayer/ cross-shaped region (FIG. 5) | concentric circular multilayer/ cross-shaped region (FIG. 5) | concentric circular multilayer/ central circle (FIG. 7(a)) |
| | Number of superposed layers | 20 | 10 | 4 | 20 | 20 |
| Compositing ingredients | Multilayer ingredient 1 (refractive index) | PET (1.66) | PET (1.66) | PET (1.66) | PET (1.66) | PET (1.66) |
| | Multilayer ingredient 2 (refractive index) | PET copolymerized with SPG and CHDC (1.53) | PET copolymerized with SPG and CHDC (1.53) | PET copolymerized with SPG and CHDC (1.53) | PET copolymerized with SPG and CHDC (1.53) | PET copolymerized with SPG and CHDC (1.53) |
| | Non-multilayer ingredient (refractive index) | 0.5 wt % CB-containing PET (1.66) | 0.5 wt % CB-containing PET (1.66) | 0.5 wt % CB-containing PET (1.66) | PET copolymerized with SSIA (1.63) | 0.5 wt % CB-containing PET (1.66) |
| Refractive-index difference | | 0.13 | 0.13 | 0.13 | 0.13 | 0.13 |
| Single-layer thickness of multilayer region (μm) | | 0.30 | 0.55 | 1.10 | 0.30 | 0.28 |
| Areal ratio (multilayer region/non-multilayer region) | | 80/20 | 80/20 | 80/20 | 80/20 | 80/20 |
| Number of multilayer-region portions | | 4 | 4 | 4 | 4 | 1 |
| Glossy sense | | excellent | good | fair | excellent | excellent |
| Structural coloring (color) | | excellent (reddish purple) | good (red) | fair (pale red) | excellent (reddish purple) | excellent (reddish purple) |
| Feeling (touch and softness) | | excellent | excellent | excellent | excellent | excellent |

| | | Example 21 | Example 22 | Comp. Ex. 10 | Comp. Ex. 11 |
|---|---|---|---|---|---|
| Single-filament fineness (dtex) | | 2.3 | 2.3 | 2.3 | 5.0 |
| Composite shape | Cross-sectional shape, Multilayer region/non-multilayer region (reference Fig.) | concentric circular multilayer/ bar-shaped region (FIG. 7(b)) | concentric elliptic multilayer/ cross-shaped region (FIG. 6) | concentric circular multilayer/ none (FIG. 8) | compressed platy multilayer/ protective layer (FIG. 9) |
| | Number of superposed layers | 20 | 20 | 24 | 40 |
| Compositing ingredients | Multilayer ingredient 1 (refractive index) | PET (1.66) | PET (1.66) | PET (1.66) | PET copolymerized with SSIA (1.63) |
| | Multilayer ingredient 2 (refractive index) | PET copolymerized with SPG and CHDC (1.53) | PET copolymerized with SPG and CHDC (1.53) | PET copolymerized with SPG and CHDC (1.53) | N6 (1.53) |
| | Non-multilayer ingredient (refractive index) | 0.5 wt % CB-containing PET (1.66) | 0.5 wt % CB-containing PET (1.66) | none | PET copolymerized with SSIA (1.63) |
| Refractive-index difference | | 0.13 | 0.13 | 0.13 | 0.10 |
| Single-layer thickness of multilayer region (μm) | | 0.30 | 0.30 | 0.36 | 0.07 |
| Areal ratio (multilayer region/non-multilayer region) | | 80/20 | 80/20 | 100/0 | 40/60 |
| Number of multilayer-region portions | | 2 | 4 | 1 | 1 |
| Glossy sense | | excellent | excellent | poor | poor |
| Structural coloring (color) | | excellent (reddish orange) | excellent (reddish purple) | excellent (reddish purple) | excellent (purple) |
| Feeling (touch and softness) | | excellent | Good | excellent | poor |

SPG, spiroglycol;
CHDC, cyclohexanedicarboxylic acid;
SSIA, 5-sodiumsulfoisophthalic acid

TABLE 7

| | | Example 23 | Example 24 | Example 25 | Example 26 |
|---|---|---|---|---|---|
| Single-filament fineness (dtex) | | 3.5 | 2.3 | 2.3 | 2.3 |
| Composite Shape | Cross-sectional shape, Multilayer region/non-multilayer region (reference Fig.) | concentric circular multilayer/ cross-shaped region (FIG. 5) | concentric circular multilayer/ cross-shaped region (FIG. 5) | concentric circular multilayer/ cross-shaped region (FIG. 5) | concentric circular multilayer/ cross-shaped region (FIG. 5) |
| | Number of superposed layers | 20 | 20 | 20 | 20 |
| Compositing ingredients | Multilayer ingredient 1 (refractive index) | PET (1.66) | PET (1.66) | PET (1.66) | PET (1.66) |
| | Multilayer ingredient 2 (refractive index) | PET copolymerized with SPG and CHDC (1.53) | PET copolymerized with SPG and CHDC (1.53) | PET copolymerized with SPG and CHDC (1.53) | PET copolymerized with CHDM (1.58) |
| | Non-multilayer ingredient (refractive index) | 0.5 wt % CB-containing PET (1.66) | 0.5 wt % CB-containing PET (1.66) | 0.5 wt % CB-containing PET (1.66) | 0.5 wt % CB-containing PET (1.66) |
| Refractive-index difference | | 0.13 | 0.13 | 0.13 | 0.08 |
| Single-layer thickness of multilayer region (μm) | | 0.39 | 0.24 | 0.18 | 0.30 |
| Areal ratio (multilayer region/non-multilayer region) | | 80/20 | 50/50 | 30/70 | 80/20 |
| Number of multilayer-region portions | | 4 | 4 | 4 | 4 |
| Glossy sense | | excellent | good | fair | good |
| Structural coloring (color) | | excellent (blue) | excellent (bluish green) | excellent (purple) | good (reddish purple) |
| Feeling (touch and softness) | | good | excellent | excellent | excellent |

| | | Example 27 | Example 28 | Example 29 | Comparative Example 12 |
|---|---|---|---|---|---|
| Single-filament fineness (dtex) | | 2.3 | 2.3 | 2.3 | 2.3 |
| Composite Shape | Cross-sectional shape, Multilayer region/non-multilayer region (reference Fig.) | concentric circular multilayer/ cross-shaped region (FIG. 5) | concentric circular multilayer/ cross-shaped region (FIG. 5) | concentric circular multilayer/ cross-shaped region (FIG. 5) | concentric circular/ cross-shaped region (FIG. 5) |
| | Number of superposed layers | 20 | 20 | 20 | 20 |
| Compositing ingredients | Multilayer ingredient 1 (refractive index) | PET (1.66) | PBT (1.65) | N6 (1.53) | PET (1.66) |
| | Multilayer ingredient 2 (refractive index) | PBT (1.65) | PLA (1.45) | PET copolymerized with SSIA (1.63) | PET (1.66) |
| | Non-multilayer ingredient (refractive index) | 0.5 wt % CB-containing PET (1.66) | 0.5 wt % CB-containing PBT (1.65) | 0.5 wt % CB-containing N6 (1.53) | 0.5 wt % CB-containing PET (1.66) |
| Refractive-index difference | | 0.01 | 0.20 | 0.10 | 0 |
| Single-layer thickness of multilayer region (μm) | | 0.30 | 0.31 | 0.35 | — |
| Areal ratio (multilayer region/non-multilayer region) | | 80/20 | 80/20 | 80/20 | 80/20 |
| Number of multilayer-region portions | | 4 | 4 | 4 | — |
| Glossy sense | | fair | excellent | excellent | poor |
| Structural coloring (color) | | fair (reddish purple) | excellent (reddish purple) | excellent (reddish purple) | poor |
| Feeling (touch and softness) | | excellent | excellent | excellent | excellent |

SPG, spiroglycol;
CHDC, cyclohexanedicarboxylic acid;
CHDM, 1,4-cyclohexanedimethanol;
SSIA, 5-sodiumsulfoisophthalic acid While glossy fiber has been described in detail and with reference to specific examples thereof, it will be apparent to one skilled in the art that various changes and modifications can be made therein without departing from the scope thereof. This application is based on a Japanese patent application filed on Nov. 15, 2016 (Application No. 2016-222338) and a Japanese patent application filed on Jun. 30, 2017 (Application No. 2017-128833), the entire contents thereof being incorporated herein by reference.

INDUSTRIAL APPLICABILITY

The fiber has a deep lustrous gloss and can be processed into woven or knit fabrics having a good touch and a soft feeling and suitable for use in garment applications. Owing to this, the fiber can be extensively used in garment/apparel applications including general garment applications such as inner and outer wear and interior applications such as curtains and cloths. From the standpoint that functions can be imparted by controlling the cross-sectional structure of the fiber or the particles to be contained, the fiber is suitable for use not only in apparel applications but also in sports-wear and industrial material applications.

The invention claimed is:

1. A glossy fiber having, in a visible-light wavelength region, an average reflectance of 20% or higher, an average transmittance of 40% or less, and a contrast gloss of 3.0 or less, wherein the glossy fiber 1) contains light-absorbing particles in an amount of 0.01-1.0 wt % in at least one polymer constituting the fiber, the light-absorbing particles having an average transmittance of 40% or less in the visible-light wavelength region, and 2) has a cross-section comprising a multilayer region comprising superposed layers of two polymers, and a non-multilayer region comprising a polymer that differs in kind from the polymers of the multilayer region.

2. The glossy fiber according to claim 1, having a cross-section along a direction perpendicular to a fiber axis, the cross-section having an inscribed circle diameter $R_B$ and a circumscribed circle diameter $R_C$ for the fiber having a relationship represented by $1.0 \leq R_C/R_B \leq 3.0$.

3. The glossy fiber according to claim 1, containing air voids in a number density of 5.0 voids/$\mu m^2$ or higher in at least one polymer constituting the fiber.

4. The glossy fiber according to claim 1, wherein, in the multilayer region, the different polymers are concentrically superposed in layers, the layers each having a thickness of 0.01 μm to 1.0 μm, the number of the superposed layers being 5 or larger.

5. The glossy fiber according to claim 1, wherein, in the cross-section, an areal proportion of the multilayer region to the non-multilayer region is 50/50 to 95/5.

6. The glossy fiber according to claim 1, wherein the multilayer region is divided by the non-multilayer region into two or more portions.

7. A fibrous product, at least a part of which is constituted of the glossy fiber according to claim 1.

* * * * *